US007076961B2

(12) United States Patent
Takusagawa

(10) Patent No.: US 7,076,961 B2
(45) Date of Patent: Jul. 18, 2006

(54) CONTROL SYSTEM WITH COMMUNICATION FUNCTION AND FACILITY CONTROL SYSTEM

(75) Inventor: Masaru Takusagawa, Yamanashi (JP)

(73) Assignee: Kitz Corporation, Chiba (JP)

( * ) Notice: Subject to any disclaimer, the term of this patent is extended or adjusted under 35 U.S.C. 154(b) by 89 days.

(21) Appl. No.: 10/800,656

(22) Filed: Mar. 16, 2004

(65) Prior Publication Data

US 2004/0173690 A1 Sep. 9, 2004

Related U.S. Application Data

(62) Division of application No. 10/070,451, filed as application No. PCT/JP00/05485 on Aug. 17, 2000, now Pat. No. 6,736,328.

(30) Foreign Application Priority Data

Jul. 28, 2000 (JP) ..... 2000-229455
Jul. 28, 2000 (JP) ..... 2000-229535

(51) Int. Cl.
*F25B 49/00* (2006.01)

(52) U.S. Cl. ..... 62/157; 62/127; 62/264; 236/94; 236/46 C; 236/49.3; 165/238

(58) Field of Classification Search ..... 62/125, 62/126, 127, 129, 130, 161, 162, 163, 164, 62/157, 231, 175, 264; 236/94, 49.3, 46 R, 236/46 F, 46 C; 165/200, 238, 239
See application file for complete search history.

(56) References Cited

U.S. PATENT DOCUMENTS

| | | | | |
|---|---|---|---|---|
| 4,358,050 | A * | 11/1982 | Naganoma et al. | 236/49.3 |
| 5,230,467 | A * | 7/1993 | Kubsch et al. | 62/127 |
| 5,259,553 | A * | 11/1993 | Shyu | 236/49.3 |
| 5,383,336 | A | 1/1995 | Nishida et al. | |
| 5,390,206 | A | 2/1995 | Rein et al. | |
| 5,603,225 | A | 2/1997 | Tobi et al. | |
| 5,630,324 | A | 5/1997 | Yoshida et al. | |
| 5,718,120 | A * | 2/1998 | Sakurai | 62/163 |
| 5,729,989 | A * | 3/1998 | Sunaga et al. | 62/163 |
| 5,927,398 | A | 7/1999 | Maciulewicz | |
| 6,126,080 | A | 10/2000 | Wada | |

FOREIGN PATENT DOCUMENTS

| | | |
|---|---|---|
| JP | 7-19584 | 1/1995 |
| JP | 11-6644 | 1/1999 |
| JP | 11-14130 | 1/1999 |
| JP | 11-281132 | 10/1999 |
| JP | 11-287499 | 10/1999 |
| JP | 1-277164 | 11/1999 |
| JP | 11-311463 | 11/1999 |
| JP | 11-312194 | 11/1999 |

* cited by examiner

*Primary Examiner*—Harry B. Tanner
(74) *Attorney, Agent, or Firm*—Oblon, Spivak, McClelland, Maier & Neustadt, P.C.

(57) ABSTRACT

A control system with a communication function wherein: a central unit communicates 30 with a plurality of devices 11, 12, . . . , monitors and manages the operations of the devices; and each of the devices includes an input section for entering position data thereof. The central unit receives the position data and an identification data of each device, and includes a unit for making the identification data correspond to the position data for each device.

2 Claims, 28 Drawing Sheets

| ROOM NO. | COMM UNICATION ADDRESS |
|---|---|
| 101 | 10456 |
| 102 | 10557 |
| ⋮ | ⋮ |

FIG. 21

| ITEMS | CONTENTS | REMARKS |
|---|---|---|
| LOGIC | SIGNAL GENERATED BY CONTACT a | WHEN CONTACT A IS CLOSED, THE FOLLOWING ARE EXECUTED. |
| | SIGNAL GENERATED BY CONTACT b | WHEN CONTACT B IS OPENED THE FOLLOWING ARE EXECUTED. |
| OPERATION | OPERATION CONTINUATION | CONTINUING CURRENT OPERATION |
| | OPERATION SUSPENSION | SUSPENDING OPERATION |
| | START (IN OCCUPIED ROOM MODE) | STARTING OPERATION IN OCCUPIED ROOM MODE |
| | START (IN PREPA-RATION MODE) | STARTING OPERATION IN PREPARATION MODE |
| | START (IN VACANT ROOM MODE) | STARTING OPERATION IN VACANT ROOM MODE |
| PROCESSING | PROBLEM INDICATION | MAKING PROBLEM INDICATION |
| | NO-PROBLEM INDICATION | NOT MAKING PROBLEM INDICATION |

CONTROL SYSTEM WITH COMMUNICATION FUNCTION AND FACILITY CONTROL SYSTEM

This application is a Division of application Ser. No. 10/070,451 filed on Mar. 20, 2002 now U.S. Pat. No. 6,736,328.

FIELD OF THE INVENTION

The present invention relates to a control system with a communication function in which a central unit communicates with a plurality of devices in order to monitor or manage their operations, and a facility control system for managing the operation of air conditioners and so on.

DESCRIPTION OF THE RELATED ART

In a control system with a communication function, a central unit including a central monitoring and/or managing device communicates with various devices in order to monitor or manage their operations. Usually, the devices have their own identification data such as communication addresses in order to communicate with the central unit. The central unit detects a particular device on the basis of position data (e.g. a room number) of a room where the device is installed. Therefore, there should be the correspondence between the identification data and the position data of each device. Usually, the identification data and position data of the devices have been inputted in the central unit in accordance with specifications thereof.

A facility control system of the related art includes a central monitoring unit for monitoring the overall states of facilities in a building, a plurality of facility control units for managing air-conditioners, illumination equipment, disaster prevention equipment and so on in individual rooms, and a control panel used for issuing various commands. The central monitoring unit communicates with the facility control units in accordance with predetermined communication protocol, thereby controlling the devices. Each facility control unit has an output section which is connected to air-conditioners, illumination equipment, disaster prevention equipment and so on, and has an input section which is connected to devices such as room temperature sensors. The facility control units control the operation of the devices connected to the output section on the basis of signals inputted by the input devices and the control panel.

Japanese Patent Laid-Open Publication No. Hei 11-281132 describes the centralized processing type control system, in which the facility control unit stores a plurality of different communication control programs in order to be compatible with devices of various manufacturers.

Further, Japanese Patent Laid-Open Publication No. Hei 11-312194 discloses the centralized processing type control system, in which the facility management units observe managing states of a building using a general browser program of existing general-purpose computers operated in a LAN, and can easily update data concerning installed positions of various devices or add data concerning added functions.

Recently, a decentralized processing type control system is being used in place of the foregoing centralized processing type control systems. Specifically, the decentralized control system uses standardized network protocol in order to be compatible with various devices and various kinds of software, and has been employed by a number of users. This is effective in reducing a system cost.

However, the foregoing control systems with the communication function are remote from devices to be monitored and managed, so that it is very difficult to check whether or not received identification data and position data correctly correspond to one another. Further, it is difficult to update the correspondence between the identification data and position data when devices are added, removed or changed.

With the foregoing centralized processing type control systems, devices are managed under communication control peculiar to them. Therefore, it is not possible to select devices as desired, to restructure or to renew the control system. Although the decentralized type control system such as Lon Works is advantageous in view of simplified installation work and reduced cost, it is mainly intended for use with automated conveying systems in large industrial works, but has not been applied to facility control systems in buildings or the like. In other words, convenient techniques have not been proposed up to now with respect to actual installation methods and operation of the facility control systems.

Further, the foregoing facility control systems have the predetermined connections between input and output terminals in the input and output sections and various equipments to be managed. It is not possible to freely connect devices to the input and output terminals. As a result, it is very difficult to add, remove or remodel devices, and it is expensive to reconstruct the facility control systems.

Therefore, a first object of the present invention is to provide a control system with a communication function which can automatically and reliably establish the correspondence between identification data and position data of individual devices, and automatically update the foregoing correspondence at the time of addition, removal or change of the devices.

It is a second object of the invention to provide a control system with a communication function which can automatically and reliably make the correspondence between identification data and position data of individual devices, and automatically update the correspondence at the time of addition, removal or model change of the devices, and in which a central control unit can gain access to devices only on the basis of the position data in accordance with application software.

A third object of the invention is to provide a facility control system which is compatible with not only existing centralized processing type control systems but also decentralized processing type control systems using standardized network protocol.

A fourth object of the invention is to provide a facility control system which is compatible with existing centralized and decentralized processing type control systems, and can take energy saving measures by automatically air-conditioning rooms only when they are occupied, for example.

It is a fifth object of the invention to provide a facility control system which is compatible with existing centralized and decentralized processing type control systems, and can blow sterile air when an air-conditioner is working in a blow mode.

It is a sixth object of the invention to provide a facility control system which is compatible with existing central processing type and decentralized type control systems, and can automatically ventilate rooms.

A final object of the invention is to provide a facility control system which allows addition, removal or remodeling of devices connected to a general output section, and can reduce renewal cost.

SUMMARY OF THE INVENTION

There is provided a control system with a communication function wherein: a central unit communicates with a plurality of devices, monitors and manages the operations of the devices; each of the devices includes an input unit for entering position data thereof; and the central unit receives the position data and identification data of each device, and includes a unit for making the identification data correspond to the position data for each device. According to the invention, it is possible to automatically and correctly correlate the identification data and position data of respective devices. Further, even when devices are added, removed or changed, the identification data and position data can be automatically and correctly correlated only by inputting only the position data.

In the foregoing control system, the central unit further includes a converter for converting the position data into the identification data on the basis of the correspondence between the position data and the identification data, and gains access to the device in accordance with the identification data. It is possible to automatically and correctly correlate the identification data and position data of respective devices. Further, even when devices are added, removed or changed, the identification data and position data can be automatically and correctly correlated only by inputting only the position data. The central unit can gain access to the devices using an application program.

Further, there is provided a facility control system comprising: a plurality of facility control units for controlling the operations of devices; a plurality of communication units detachably provided for the devices; and a central unit for controlling the operations of the devices via the communication units, wherein the facility control units directly control devices when no communication unit is provided, and control devices under control of the central unit via the communication units when communication units are provided. The facility control system is compatible with an existing centralized processing type control system but also with an existing decentralized processing type control system using standardized communication protocol.

With the foregoing facility control system, each facility control unit automatically controls the operation of an air-conditioner in each room in response to a signal from an occupancy sensor; The facility control system is compatible with the centralized and decentralized processing type control systems. It is possible to automatically air-condition an occupied room or operate an air-conditioner in an energy saving mode.

The facility control unit activates a sterilizing lamp for sterilizing air during a blow mode. The facility control system is compatible with the centralized and decentralized processing type control systems and can blow sterilized air to a room during the blow mode.

Further, the facility control unit activates a ventilator in each room when a room temperature detected by a room temperature sensor is equal to or higher than a predetermined temperature. The facility control system is compatible with the centralized and decentralized processing type control systems and can automatically ventilate a room.

Still further, there is provided a facility control system comprising control units each of which controls devices and includes: a general output section to which the devices are connected; a memory storing a plurality of control patterns for controlling the devices; and a control pattern selector for selecting any of the control patterns for controlling devices. Therefore, it is possible to add, remove or change devices connected to the general output section at a reduced cost.

The facility control system further comprises a general input section to which optional devices are connected. The control pattern selector selects any of the control patterns for first devices connected to the general output section, and the control unit controls second devices connected thereto in accordance with control patterns selected in response to signals received from the devices connected to the general input section. Therefore, it is possible to add, remove or change devices connected to the general input section at a reduced cost.

BRIEF DESCRIPTION OF THE DRAWINGS

FIG. 21 shows the initialization performed according to the invention.

DETAILED DESCRIPTION OF THE PREFERRED EMBODIMENT

Figures 1, 2:
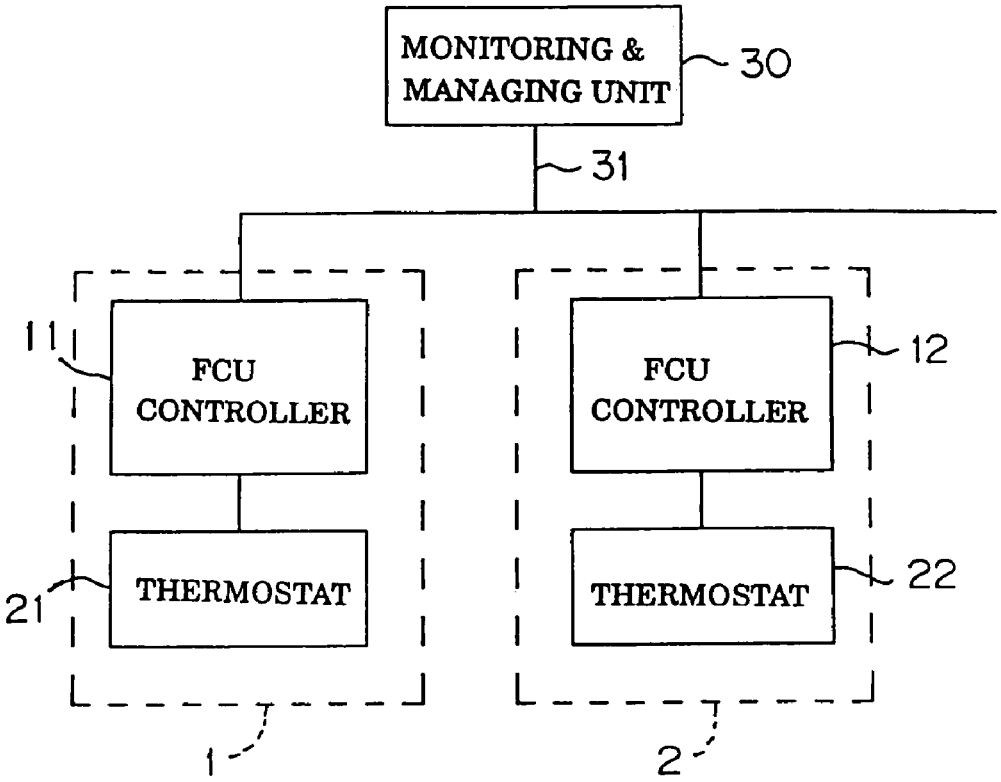
FIG. 1 is a block diagram showing the configuration of a control system in one embodiment of the invention.
FIG. 2 shows the correspondence between communication addresses and room numbers used in the embodiment.

The invention will be described with reference to one embodiment shown in FIG. 1. In this embodiment, a control system with a communication function is used to manage facilities in a building. Rooms 1, 2, . . . are provided with facility control units, i.e. fan coil unit controllers (called "FCU controllers") 11, 12 . . . and thermostats 21, 22. The thermostats 21, 22 . . . are used to set room temperatures, and the FCU controllers 11, 12 . . . control the temperatures of individual rooms 1, 2, . . . in order to cool or heat them or blow air to them.

A monitoring and managing unit 30 as a central control unit is connected to, communicates with and controls the FCU controllers 11, 12, . . . via a network 31, thereby monitoring and managing the operations of air-conditioners and so on in the rooms 1, 2.

The thermostats 21, 22 . . . are also used to input room numbers as position data peculiar to the FCU controllers 11, 12 . . . . The FCU controllers 11, 12 . . . store the received room numbers in particular memory regions. The monitoring and managing unit 30 receives identification data, e.g. communication addresses and room numbers, of the FCU controllers 11, 12 . . . via the communication network 31 which uses a communication protocol such as Lon Works or the like. Then, the monitoring and managing unit 30 correlates the communication addresses to the room numbers for the individual FCU controllers 11, 12 . . . and stores them in a file as shown in FIG. 2.

Figure 3:
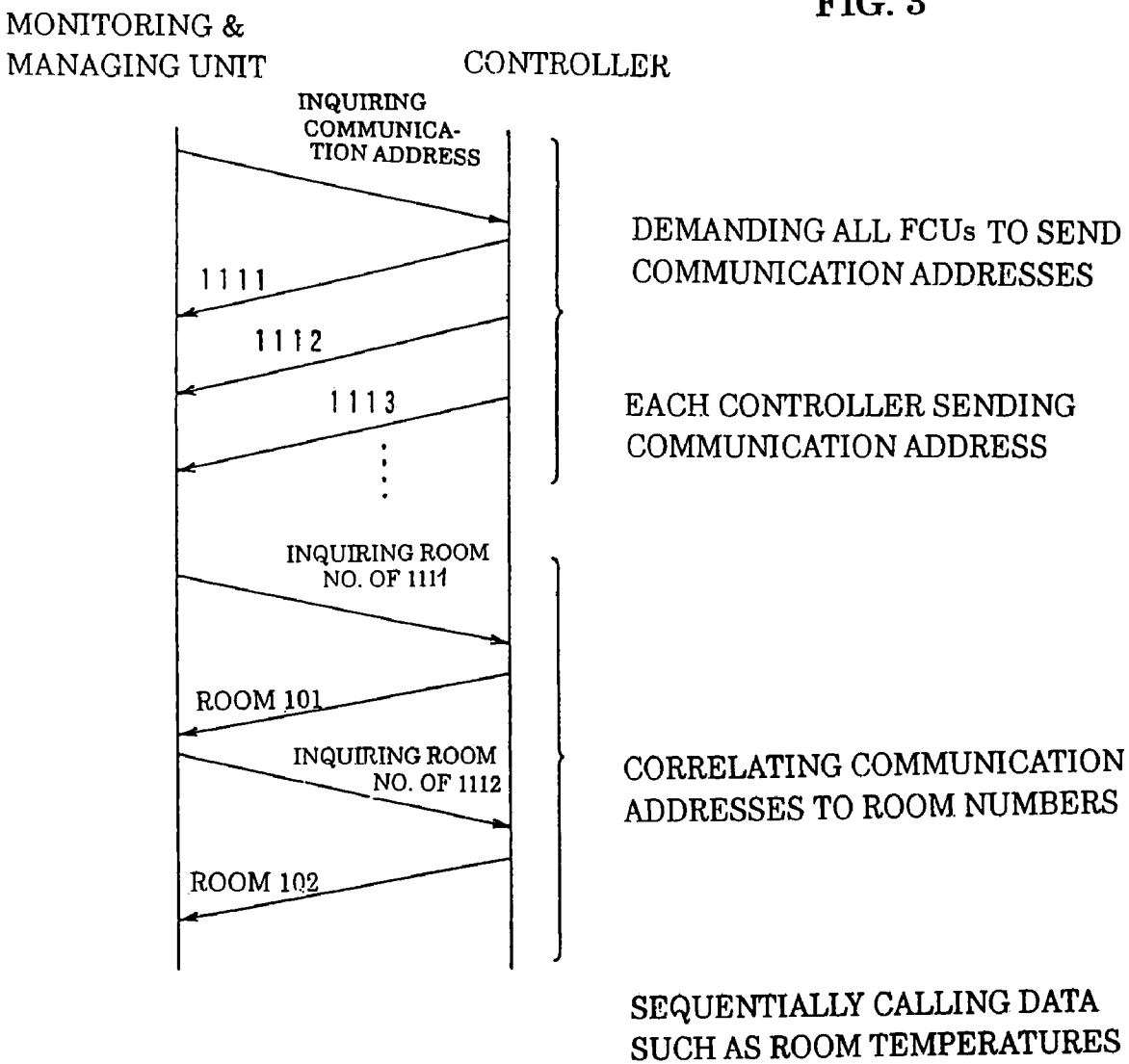
FIG. 3 shows how room numbers and the communication addresses are processed.
Figure 4:
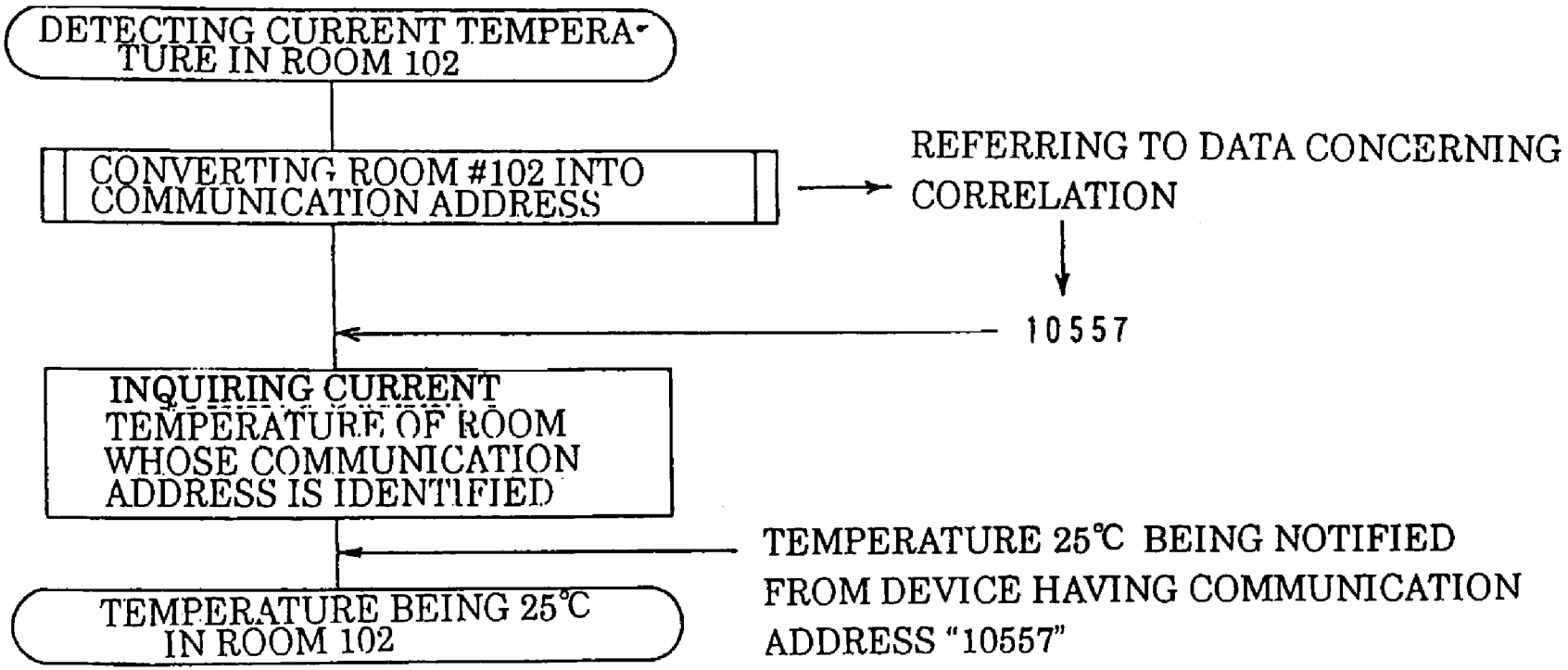
FIG. 4 is a flowchart showing how a device in a particular room is managed on the basis of the correspondence between the room numbers and communication addresses.

Referring to FIG. 3, the monitoring and managing unit 30 requests the FCU controllers 11, 12 . . . to send their communication addresses, identifies room numbers on the basis of the received communication addresses, correlates them, and stores them at a storage region in the file.

The monitoring and managing unit 30 gains access to the FCU controllers 11, 12 . . . on the basis of the room numbers stored in the files. For example, in order to detect a current temperature of a room 102, the monitoring and managing unit 30 converts the identification data of the room 102 into the communication address, using an interface for converting the room numbers into communication addresses (which may be functions or a sub-program) and the correspondence between the communication addresses and position data. The monitoring and managing unit 30 inquires the current temperature of the room having the received communication address, and obtains the current temperature of the room 102, e.g. 25° C.

Figure 5:
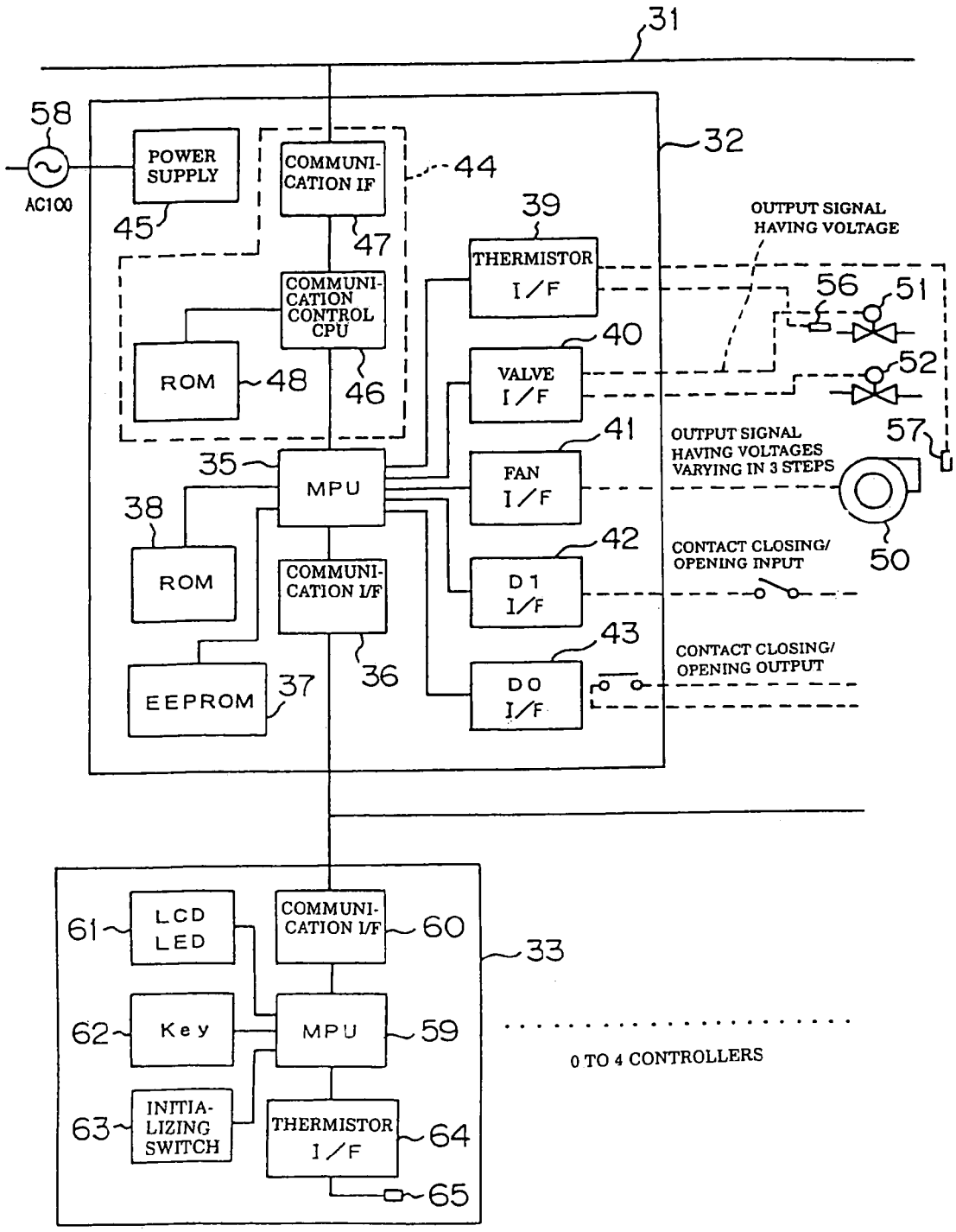
FIG. 5 is a block diagram of an FCU controller used in the embodiment.

As shown in FIG. 5, an FCU controller 32 is connected to at least one thermostat 33, and includes an MPU 35 as a control unit, a communication interface (the interface is called "I/F" hereinafter) 36, an EEPROM 37 (a non-volatile memory), a ROM 38 for storing a control program, a thermistor I/F 39, a valve I/F 40, a fan I/F 41, a general input section 42, a general output section 43, a communication interface unit 44 accessible to the monitoring and managing unit 30, and a power source 45. The communication interface unit 44 is a detachable module.

The communication interface unit 44 includes a communication control CPU 46, a communication I/F 47 and a ROM. An FCU 50 includes a fan and a coil and cold-hot water control valves 51 and 52, and constitutes an air conditioner as a building facility.

Figure 6:
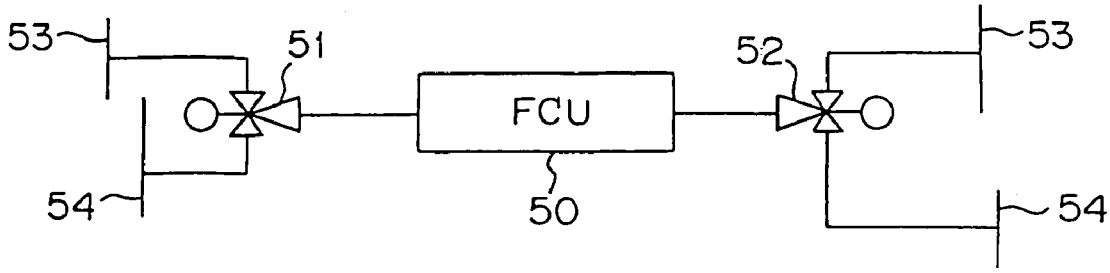
FIG. 6 is a piping diagram of the FCU controller.

When the FCU 50 is of a four-pipe selecting type, two 3-way valves 51 and 52 are used as shown in FIG. 6 in order to control cooling/heating water temperatures. A coil of the FCU 50 has opposite ends thereof connected to cold water pipes 53 and hot water pipes 54, both of which are connected to a cooling/heating water supply, not shown. The valves 51 and 52 are controlled by the MPU35 via the valve I/F 40, and selectively connect the coil of the FCU 50 to either the cold or hot water pipes 53 or 54.

In a cooling mode, the cooling/heating water supply provides cold water as a refrigerant, which is introduced into the coil of FCU 50 via the cold water pipes 53 and valves 51 and 52. The coil of the FCU 50 cools hot air, so that cool air circulates via the fan of the FCU 50 and cools the room. On the other hand, in a heating mode, the cooling/heating water supply provides hot water as a heating medium to the coil of the FCU 50 via the hot water pipes 54 and valves 51 and 52. The coil of the FCU 50 heats the cold air, so that hot air circulates and heats the room.

Figure 7:
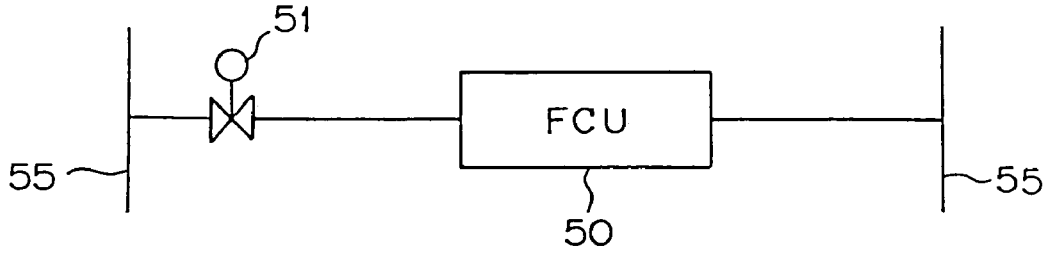
FIG. 7 is a another piping diagram of the FCU controller.

When the FCU 50 is of a 2-pipe-and-1-coil type, the valve 51 is a two-way valve as shown in FIG. 7 in order to supply cold or hot water. The coil of the FCU 50 has its opposite ends connected to cold/hot water pipes 55, which is connected to the cooling/heating water supply. The valve 51 is controlled by the MPU 35 via the valve I/F 40.

During the cooling mode, cooling water is introduced into the coil of the FCU 50 from the cooling/heating water supply via the cold/hot water pipes 55 and the valve 51. The coil of the FCU 50 cools the hot air, so that cool air circulates via the fan of the FCU 50 and cools the room. In the heating mode, hot water is introduced into the coil of the FCU 50 from the cooling/heating water supply via the cooling/heating water pipes 55 and the valve 51. The coil of the FCU 50 heats the cold air, so that hot air circulates via the fan of the FCU 50 and heats the room.

Figure 8:
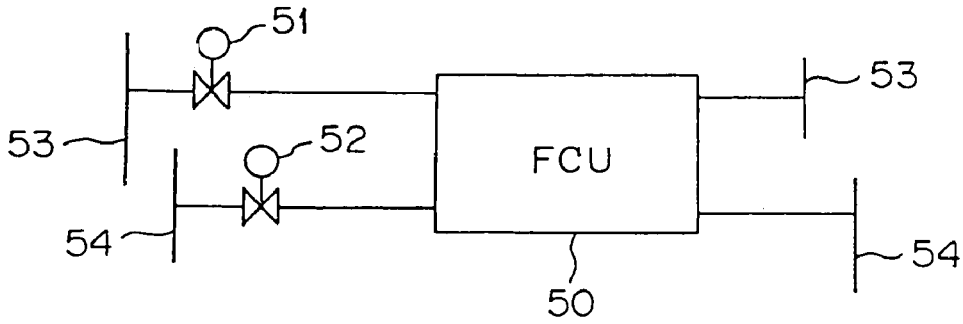
FIG. 8 is a further piping diagram of the FCU controller.

If the FCU 50 is of a four-pipe type, two 2-way valves are used as the cold/hot water controlling valves 51 and 52 as shown in FIG. 8. The coil of the FCU 50 has opposite ends thereof connected to the cold water pipes 53 via the valve 51 and to the hot water pipes 54 via the valve 52, both of which are connected to the cooling/heating water supply. The valves 51 and 52 are controlled by the MPU 35 via the valve I/F 40.

In the cooling mode, cold water is introduced from the cooling/heating water supply into the coil of the FCU 50 via the cold water pipes 53 and the valve 51. The coil of the FCU 50 cools hot air, so that cool air circulates via the fan of the FCU 50 in order to cool the room. In the heating mode, hot water is introduced from the cooling/heating water supply into the coil of the FCU 50 via the hot water pipes 54 and the valve 52. The coil of the FCU 50 heats cool air, so that hot air circulates via the fan of the FCU 50 and heats the room.

A piping sensor 56 is constituted by thermistors connected to the foregoing cold and hot water pipes 53 and 54 in order to detect water temperatures. Another thermistor is used as a blow sensor 57 in order to detect temperatures of air blown via the FCU 50. The piping sensor 56 and blow sensor 57 send signals to the MPU 35 via a thermistor I/F 39.

The general input section 42 is connected to necessary devices, e.g. a fan trouble sensor of which contact is turned on when the fan of the FCU 50 is faulty, and an occupancy sensor of which contact is turned on when a room is occupied. Signals from the fan trouble sensor and the occupancy sensor are inputted to the MPU 35 via the general input section 42. Appliances such as sterilizing lamps for sterilizing exhaust gases from the FCU controller 50 and ventilating fans are connected to the general output section 43.

The power supply 45 receives an AC input voltage from a commercial power supply 58, generates a desired DC voltage, and supplies it to various devices. The communication control CPU 46 sends and receives signals to and from the monitoring and managing unit 30 via the communication I/F 47 and the network 31, and communicates with the MPU 35 using the signals.

Each of the thermostats 33 includes a MPU 59 as a controller, a communication I/F 60, a display panel 61, an input unit 62, an initializing switch 63, a thermistor I/F 64, and a room temperature sensor 65. The initializing switch 63 is turned on in order to initialize the data such as control constants, general input/output control patterns and so on which are peculiar to a particular FCU controller.

Figure 9:
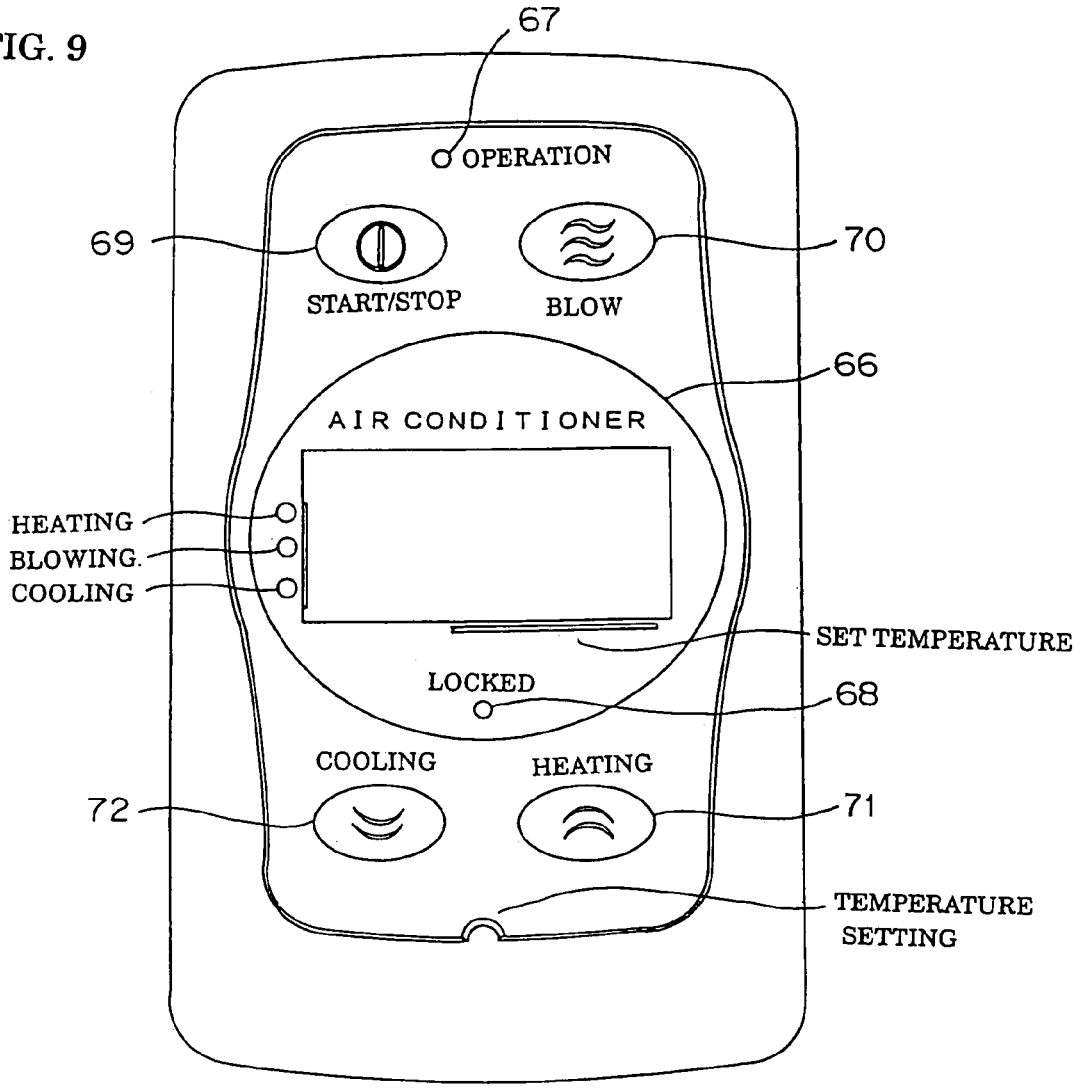
FIG. 9 is a front elevation of a controller installed in a room.

FIG. 9 is a front elevation of the thermostat 33. The display panel 61 includes a liquid crystal display 66, and LED lamps 67 and 68. The input unit 62 is provided with a start/stop key 69, a blow key 70, a heating key 71, and a cooling key 72.

The MPU 59 normally performs the following operations. In response to a signal generated by each depression of the start/stop key 69, the MPU 59 alternately selects the operation mode and the stop mode, and turns on or off the LED lamp 67 for indicating the operation or stop mode.

Further, the MPU 0.59 cyclically selects an automatic blow mode (AUTO), a light breeze mode, a moderate breeze mode or a fresh breeze mode in response to a signal from the blow key 70. However, the MPU 59 allows the operation of the blow key 70 only when fan control is initially selected. In an air-conditioning mode, the MPU 59 raises the room temperature by 0.5° C. each time the heating key 71 is depressed while the MPU 59 lowers the room temperature by 0.5° C. each time the cooling key 72 is depressed.

When the monitoring and managing unit 30 locks the operation of the devices, the MPU 59 turns on the LED lamp 68 in order to indicate this state, and disables the key operation of the input unit 62 regardless of the operation or stop mode. Otherwise, the MPU 59 turns off the LED lamp 68, and allows the key operation at the input unit 62. In either case, the monitoring and managing unit 30 sends a locking or unlocking signal to the MPU 35 via the network 31 and the communication interface unit 44. The MPU 35 transfers the locking or unlocking signal to the MPU 59 via the communication I/Fs 36 and 60.

When the room temperature indication is initially allowed, the MPU 59 enables the liquid crystal display 66 to show a room temperature, in response to a detection signal from the room temperature sensor 65 of the thermostat via the thermistor I/F 64.

The MPU 59 allows the liquid crystal display 66 to indicate a current operation mode, e.g. the heating, cooling or blow mode. Further, the MPU 59 indicates on the liquid crystal display 66, the light, moderate and fresh breezes using symbols. The liquid crystal display 66 indicates AUTO when the automatic operation mode is selected.

Further, the MPU 59 provides the MPU 35 with data concerning the operation mode specified by the start/stop key 69, blow key 70 and heating and cooling keys 71 and 72 and a slide switch, and the current room temperature, via the communication I/Fs 60 and 36. The MPU 35 controls the FCU 50 on the basis of the current operation mode and room temperature.

Figure 10:
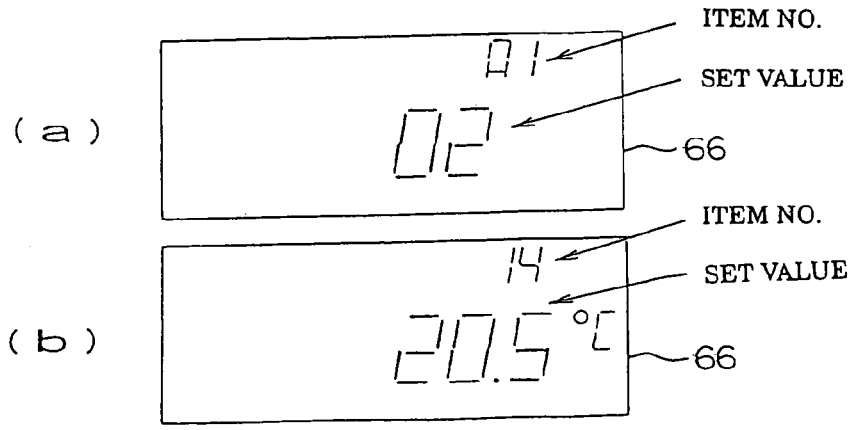
FIG. 10 shows indications on the controller at the time of initialization.

When the initializing switch 63 and the start/stop key 69 are activated while the FCU 50, sterilizing lamp and ventilator are inactive, the MPU 59 establishes an initializing mode. Thereafter, the liquid crystal display 66 indicates the initial values, e.g. a mode indication and a room temperature, as shown in FIG. 10. If no initial values are changed and if either the heating key 71 or the cooling key 72 is depressed, the MPU59 changes the indications on the liquid quartz display 66 in response to the signal from the operated key.

If the blow key 70 is depressed in this state, the MPU 59 blinks the mode indication on the liquid crystal display 66. When the heating or cooling key 71 or 72 is depressed, the MPU 59 changes the indications. Further, when the blow key 70 is re-depressed, the MPU 59 stops the blinking indications and make them steady.

The initial values represent an operated room temperature sensor, a selected piping type shown in FIG. 6 to FIG. 8, particulars of the FCU 50 and valves 51 and 52, and a room number.

When the start/stop key 69 is depressed in order to finish the initialization, the MPU 59 switches the initialization mode over to the stop mode, and transfers the initial values to the MPU 35 via the communication I/Fs 60 and 36. The MPU 35 stores them in the EEPROM 37.

The MPU 35 updates the initial values stored in the EEPROM 37 when the monitoring and managing unit 30 requests to update the initial values via the network 31 and the communication interface unit 44.

If no communication interface unit 44 is provided, the control system of this embodiment functions as a centralized processing type control system. The MPU 35 controls the operation of the valves 51 and 52, coil and fan of the FCU 50, sterilizing lamp and ventilating fan via the valve I/F 40, fan I/F 41 and the output section 43.

Specifically, the MPU 35 performs one-step or three-step control of the fan of the FCU 50 as follows in accordance with the initial fan control data stored in the EEPROM 37. In the case of the one-step control, the MPU 35 operates the fan of the FCU 50 in the initially set blow mode, i.e. the light, moderate or fresh breeze mode, via the fan I/F 41.

In the case of three-step control, the MPU 35 controls the operation of the fan of the FCU 50 in order to blow air in accordance with the light, moderate or fresh breeze mode, or AUTO mode selected by the blow key 70.

Figure 11:
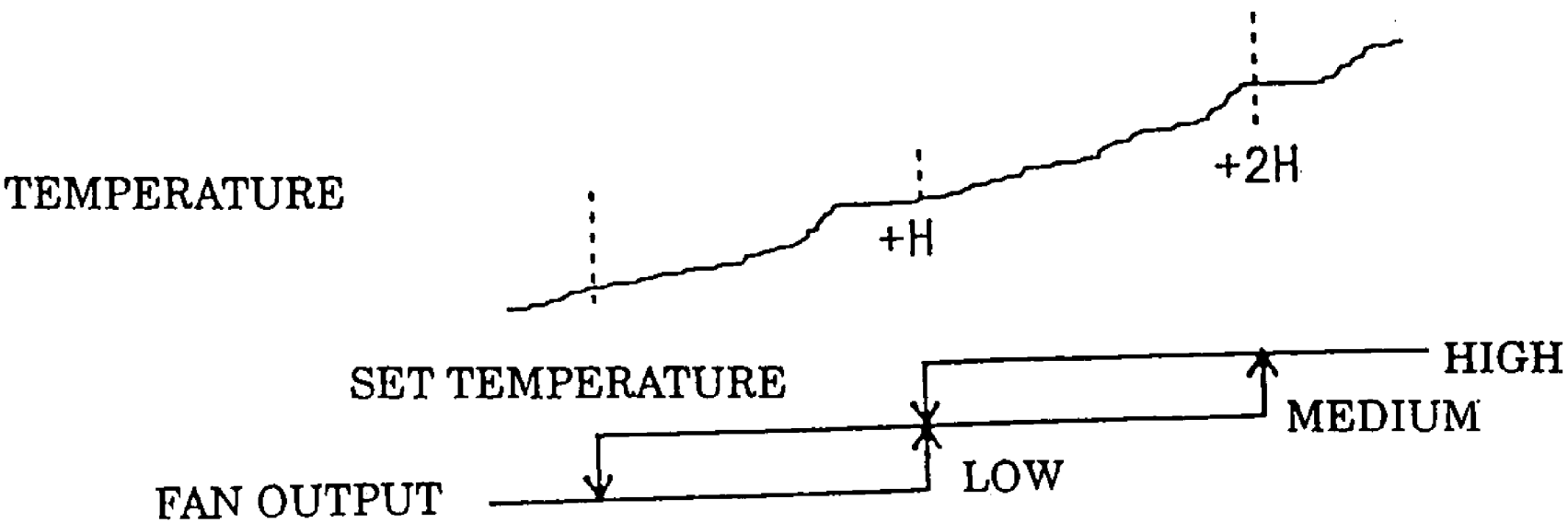
FIG. 11 shows the relationship between room temperatures and ventilating fan outputs during an automatic operation mode.

In the AUTO mode, the MPU 35 allows via the fan I/F 41 the fan of the FCU 50 to blow the moderate breeze when the temperature detected by the room temperature sensor reaches the cooling or heating hysteresis ±H (as shown in FIG. 11). Further, the MPU 35 enables the fan of the FCU 50 to blow the fresh breeze when the detected temperature reaches the cooling or heating hysteresis ±2H.

Conversely, if the detected room temperature is within the cooling or heating hysteresis ±H while the fan is operating in the fresh breeze mode, the MPU 35 operates, via the fan I/F 41, the fan of the FCU 50 in the moderate breeze mode.

Further, if the fan is in the moderate breeze mode, the MPU 35 enables the fan to operate in the light breeze mode when the detected room temperature reaches the set value.

The valve 51 is controlled as follows when the FCU 50 is of the 2-pipe-and-1-coil type as shown in FIG. 7.

Figure 12:
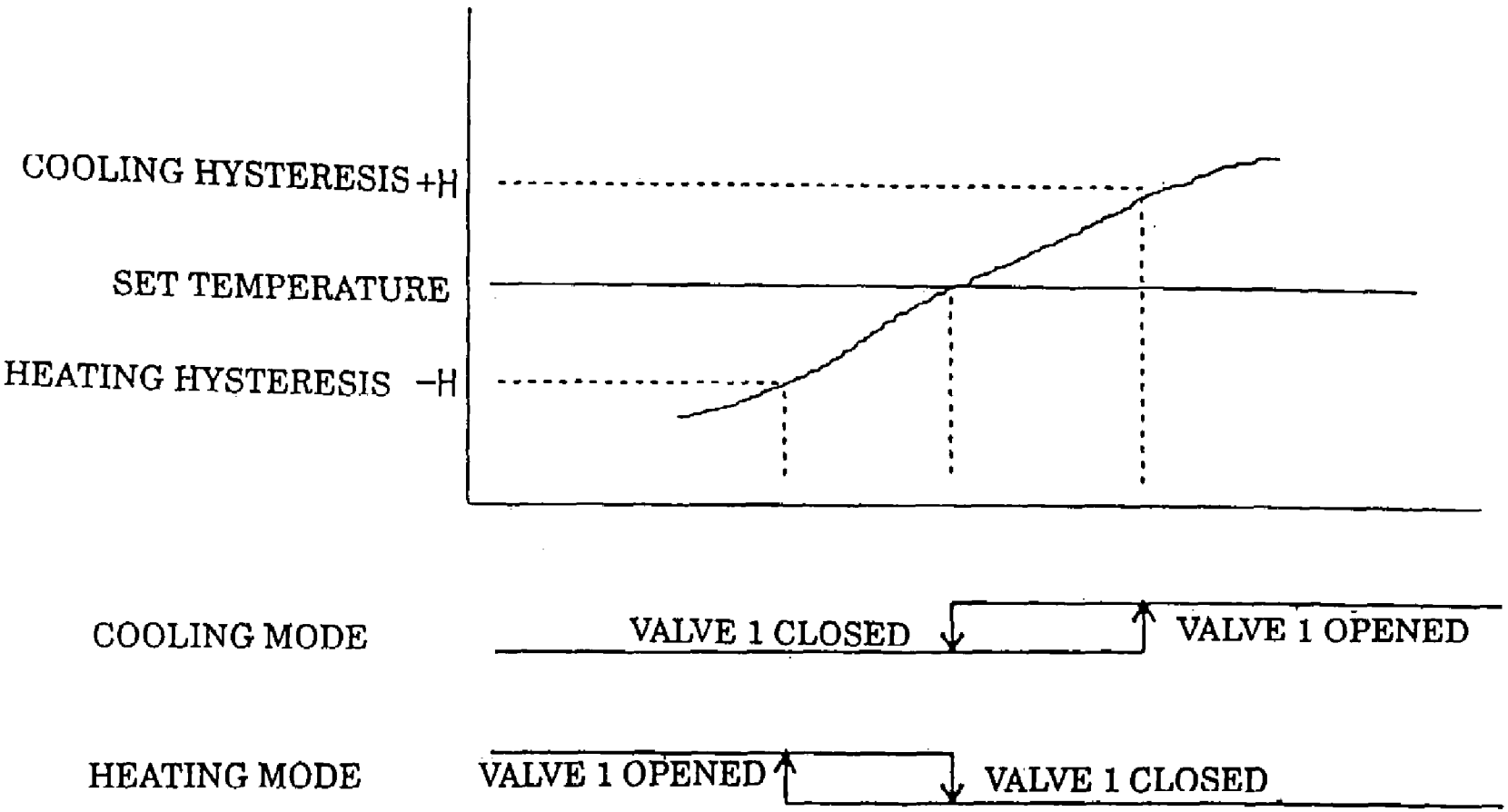
FIG. 12 shows opening and closing of valves depending upon room temperatures when the FCU controller is of 2-pipe-and-one-coil type.
Figure 13:
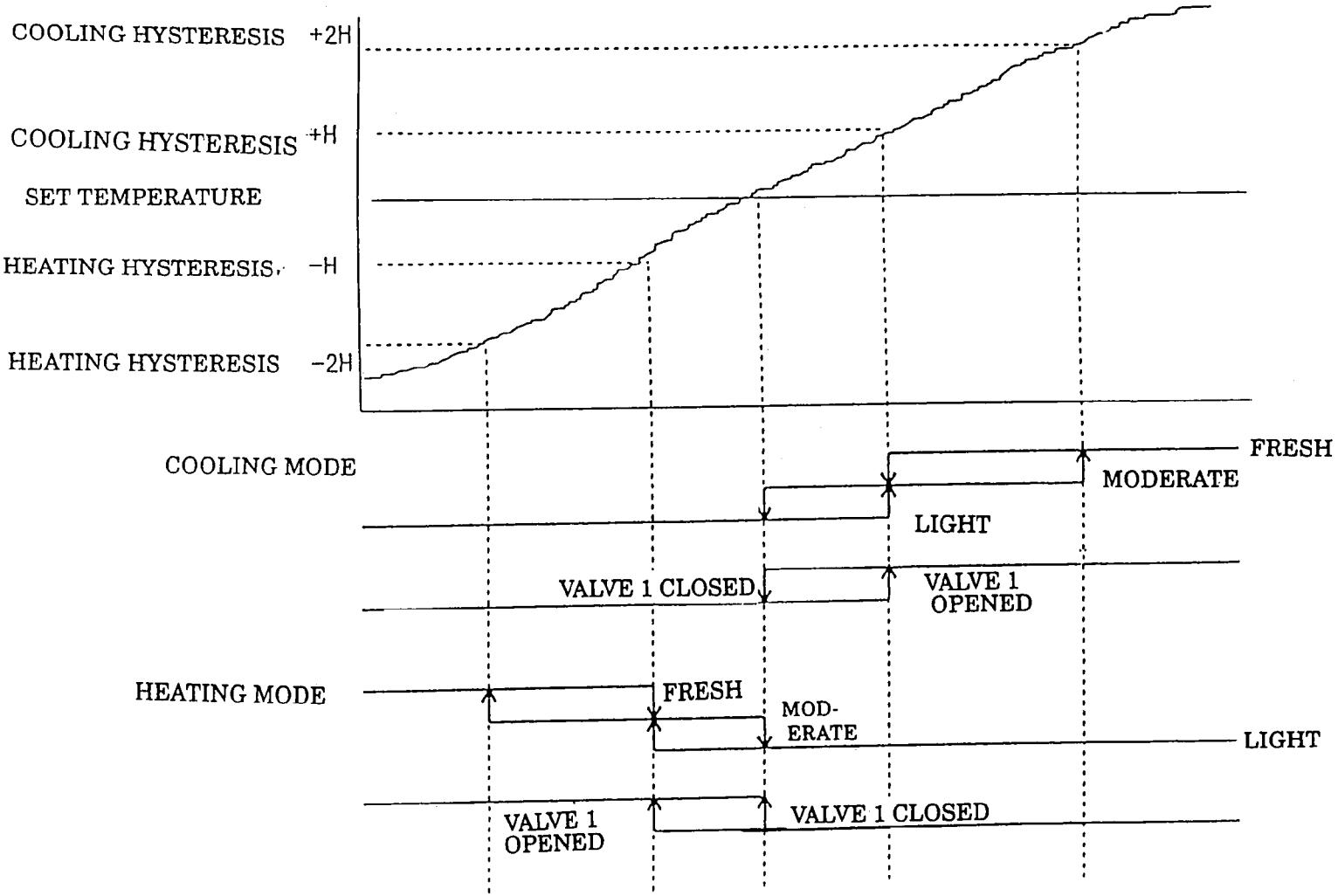
FIG. 13 shows how the valve opening and closing are controlled in the automatic operation mode when the FCU controller is of two-pipe-and-one-coil type.

It is assumed that the valve 51 is initially set to be simply opened or closed in accordance with a room temperature. When the detected room temperature reaches the cooling or heating hysteresis ±H, the MPU 35 opens the valve 51 via the valve I/F 41 as shown in FIG. 12. If the room temperature reaches the set value while the valve 51 remains open, the MPU 35 closes the valve 51 via the valve I/F 41. FIG. 13 shows the control of the valve 51 in the AUTO mode.

If the valve 51 is initially set to be proportionally opened or closed, the MPU 35 gradually opens or closes the valve 51 via the valve I/F 41 in accordance with the relationship between the set room temperature S and a current room temperature P.

The valves 51 and 52 are controlled as follows when the FCU 50 is of the four-pipe type as shown in FIGS. 6 and 8.

When the cooling mode is selected during the initialization, the MPU 35 controls the valves 51 and 52 via the valve I/F 41 in order to perform the cooling. On the other hand, when the heating mode is initially selected, the MPU 35 controls the valves 51 and 52 via the valve I/F 40 in order to perform the heating.

The MPU 35 controls the valves 51 and 52 via the valve I/F 41 in accordance with a difference between the set room temperature and the current room temperature in order to perform the cooling or heating when the automatic cooling or heating mode is initially selected. If the room temperature is above the set room temperature plus the cooling hysteresis, the MPU 35 controls the valves 51 and 52 via the valve I/F 41 in order to cool the room in accordance with the difference between the current room temperature and the set room temperature. Conversely, if the current room temperature is below the set room temperature minus the cooling hysteresis, the MPU 35 controls the valves 51 and 52 in order to heat the room in accordance with the difference between the current room temperature and the set room temperature. Otherwise, the MPU 35 selects the blow mode.

Figure 14:
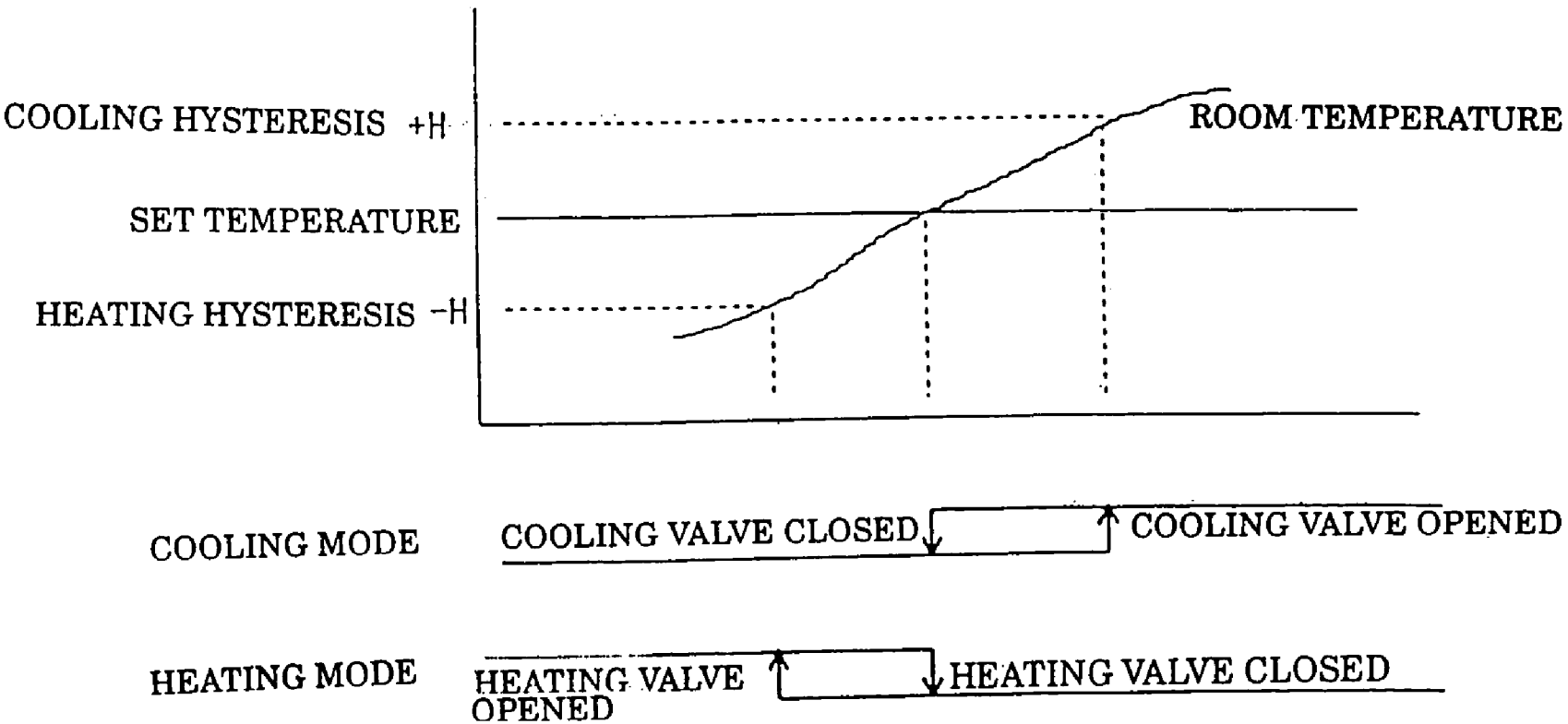
FIG. 14 shows the control of valve opening and closing when the FCU controller is of four-pipe type.

It is assumed that the valves 51 and 52 are simply opened or closed in accordance with the room temperature. If the room temperature reaches the set value, which is determined on the basis of the set hysteresis, during the normal operation while the valves 51 and 52 remain closed, the MPU 35 opens the valves 51 and 52 via the valve I/F 40. Conversely, if the room temperature reaches the set value while the valves 51 and 52 remain open, the MPU 35 closes them. Refer to FIG. 14.

If the valves 51 and 52 are initially set to be gradually opened or closed, the MPU 35 controls the opening or closing of the valves 51 and 52 in the cooling or heating mode via the valve I/F 41 in accordance with the relationship between the set room temperature and the current room temperature, as in the 2-pipe-and-1-coil piping type.

When the room is occupied, the occupancy sensor issues a signal. In response to the signal, the MPU 35 automatically starts controlling the valves 51 and 52, and fan and coil of the FCU 50, thereby air-conditioning the room. Conversely, if the occupancy sensor detects the room vacant, the MPU 35 stops the valves 51 and 52, fan and coil of the FCU 50, or maintains these units in the vacant room mode (e.g. lowers or raises the room temperature in the heating or cooling mode, or reduces an amount of air flow in the blow mode), thereby saving energy.

If the fan trouble sensor detects malfunction of the fan of the FCU 50 and issues a signal, the MPU 53 stops the device in operation, and provides a fan trouble signal to the MPU 59 via the communication I/Fs 36 and 60. Then, the liquid crystal display 66 indicates the fan trouble. Further, the MPU 35 turns on the sterilizing lamp via the output section 43 in order to sterilize air from the fan of the FCU 50 during the blow mode. Still further, when the room temperature is above or below the set value in the heating or cooling mode, the MPU 53 activates the ventilator in order to introduce fresh air into the room.

When the communication interface unit 44 is provided, the control system of this embodiment functions as a decentralized processing type control system using standardized communication protocol. The monitoring and managing unit 30 communicates with the MPU 35 via the network 31 and the communication interface unit 44 in order to monitor and control the coil and fan of the fan coil 50, sterilizing lamp, ventilating fan and so on connected to the general input and output sections.

Under the control of the monitoring and managing unit 30, the MPU 35 controls the valves 51 and 52, fan and coil of the fan coil unit 50, sterilizing lamp and ventilating fan of the controller 32, except for the communication interface unit 44, via the valve I/F 40, fan I/F and output section 43, on the basis of the following data: the initialized values stored in the EEPROM 37; the temperature detected by the thermostat and transferred from the MPU 59 via the communication I/Fs 60 and 36; a signal input from the thermistor I/F 39; signals (which are from the fan trouble sensor, the occupancy sensor and so on) input via the input section 42; and data stored in the EEPROM 37.

The monitoring and managing unit 30 acquires the following data from the MPU 35 via the network 31 and communication interface unit 44: the temperature detected by the temperature sensor, and the set temperature; the operation speed of the fan of the fan coil 50; the selected operation mode; the initially set data; the temperature detected by the piping sensor 56; the temperature detected by the blow sensor 57; heating control outputs (i.e. signals indicating states of fan coil 50 and the valves 51 and 52 in the heating mode); cooling control outputs (i.e. signals indicating states of the fan coil 50 and the valves 51 and 52 in the cooling mode); and a signal indicating the state of the fan coil 50. Based on these data, the monitoring and managing unit 30 monitors the operation states of the controller 32, fan coil 50 and valves 0.51 and 52, sends the control signals to the MPU 35 via the network 31 and communication interface unit 44, controls the fan and coil of the fan coil 50 and the valves 51 and 52, and changes the set temperature, the fan speed of the fan coil 50 and various operating conditions.

The MPU 35 has the initiative for sending and receiving the data to and from the communication interface unit 44 using a token. The token should be used for transmitting the data, is created at the time of communication initialization, and is continuously possessed by the MPU 35. In other word, the data cannot be transmitted until the communication interface unit 44 receives the token from the MPU 35.

Figure 15:
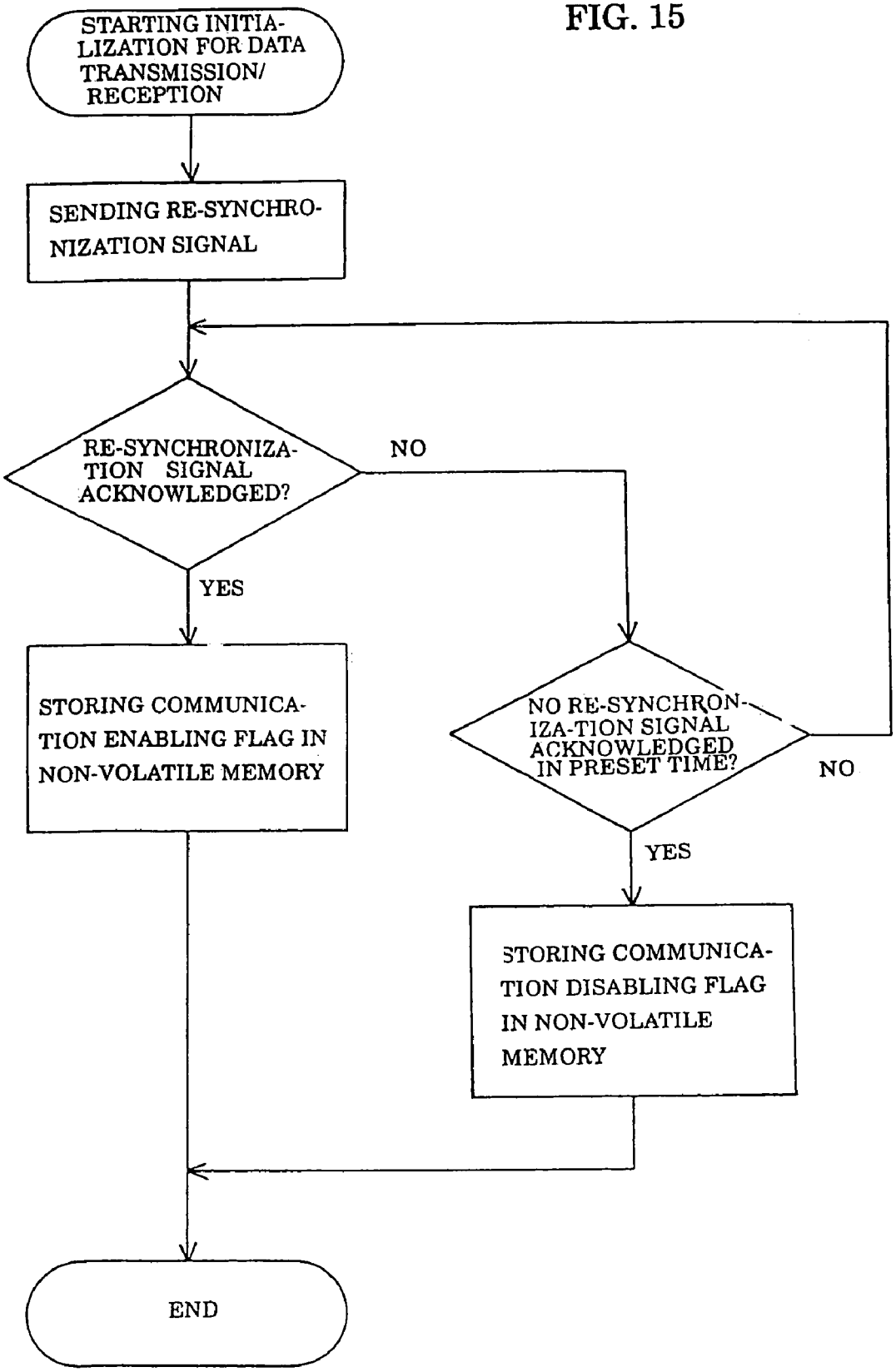
FIG. 15 is a flowchart showing communication initialization at a control unit.

FIG. 15 is the flowchart showing the data transmission/reception initialization at the MPU 35. The MPU 35 transmits re-synchronization data to the communication interface unit 44. Receiving the acknowledgement from the communication interface unit 44, the MPU 35 communicates with the communication interface unit 44, and stores a communication enabling flag in the non-volatile memory. Conversely, if no acknowledgement is received from the communication interface unit 44 within a preset time period, the MPU 35 stores in the non-volatile memory a communication disabling flag representing that no communication is allowed with the communication interface unit 44.

Figure 16:
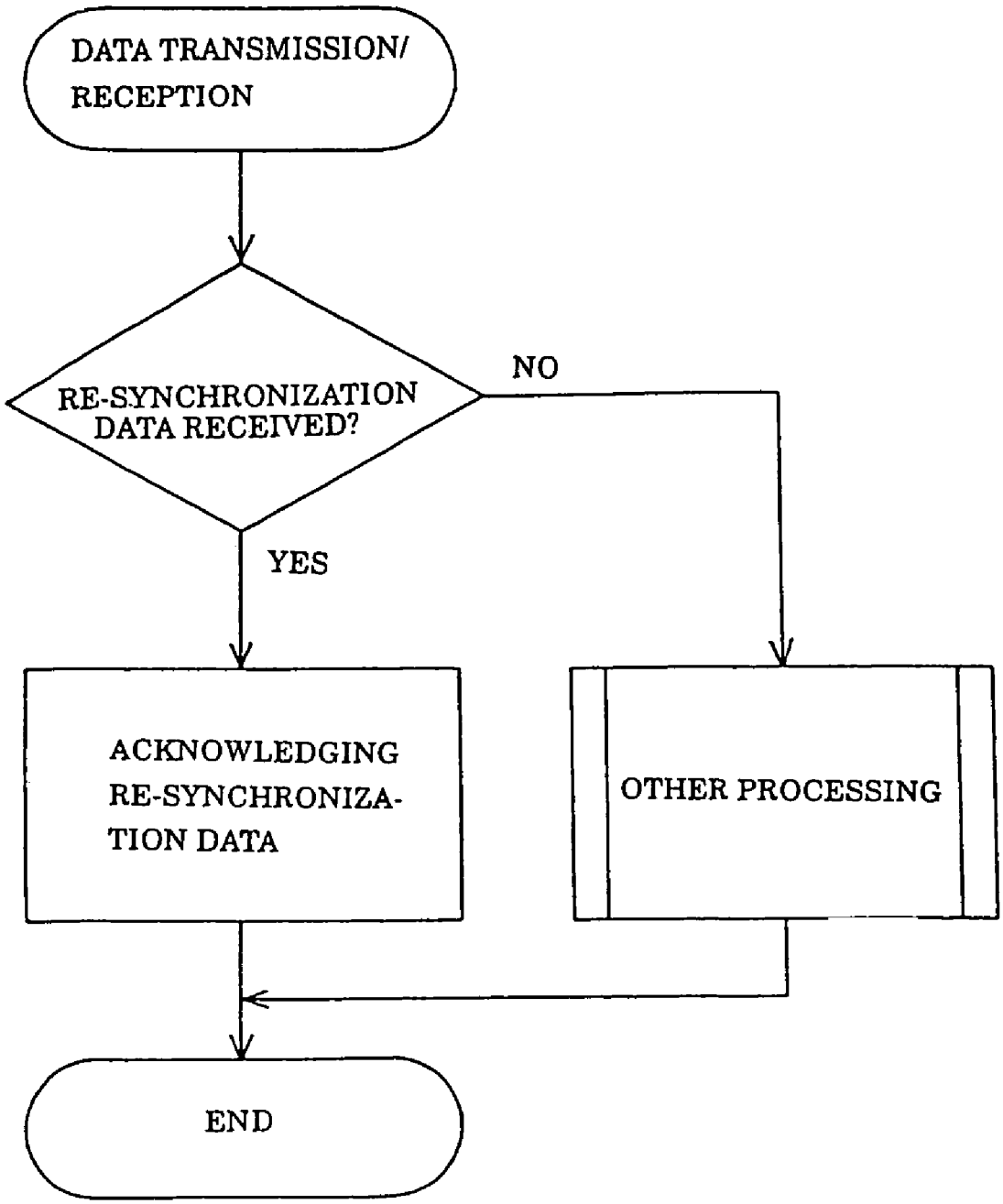
FIG. 16 is a flowchart showing communication initialization at a communication interface unit.

The communication interface unit 44 performs the communication initialization as shown in FIG. 16. Receiving the re-synchronization data from the MPU 35, the communication interface unit 44 acknowledges the data to the MPU 35. If no acknowledgement is received from the communication interface unit 44, the MPU 35 proceeds to another processing.

The MPU 35 determines whether or not the data can be sent to and received from the communication interface unit 44, and stores the determined results in the non-volatile memory.

Figure 17:
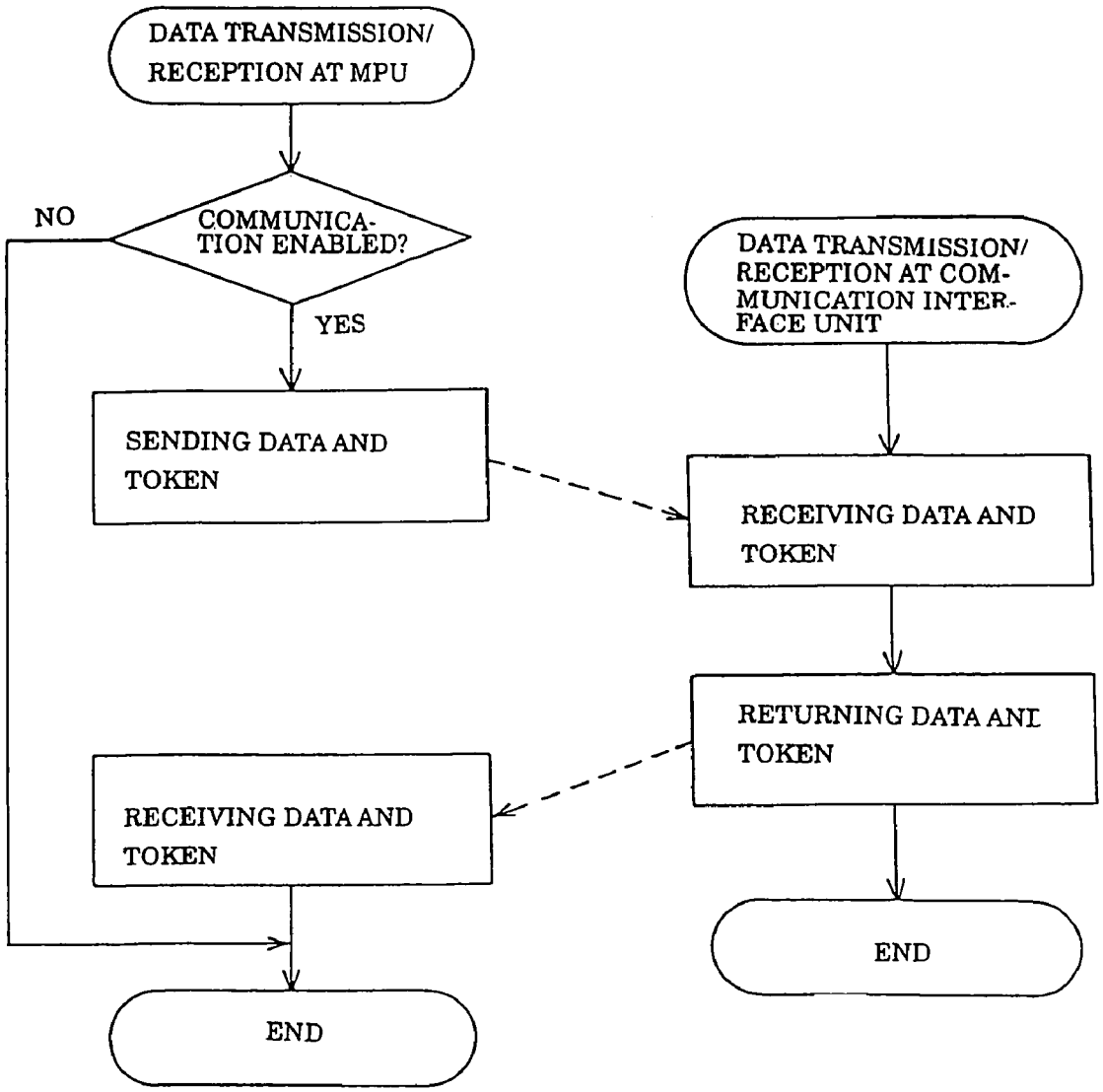
FIG. 17 is a flowchart showing communication control at the control unit.

The MPU 35 transmits and receives the data to and from the communication interface unit 44 as shown in FIG. 17. Specifically, the MPU 35 determines whether or not the communication with the communication interface unit 44 is possible on the basis of the communication enabling or disabling flag. If possible, the MPU 35 sends the data and the token to the communication interface I/F 44, and receives the data and the token from the communication interface I/F 44. Further, receiving the data and token from the MPU 35, the communication interface unit 44 returns them to the MPU 35.

As described above, the MPU 35 has the communication initiative, checks the communication enabling or disabling flag prepared for individual FCU controllers at the time of communication initialization, and sends and receives the data only when the communication enabling flag is recognized. Therefore, it is possible to minimize processing overhead of controllers 32 and thermostats 33 when no communication interface unit 44 is provided.

Figure 18:
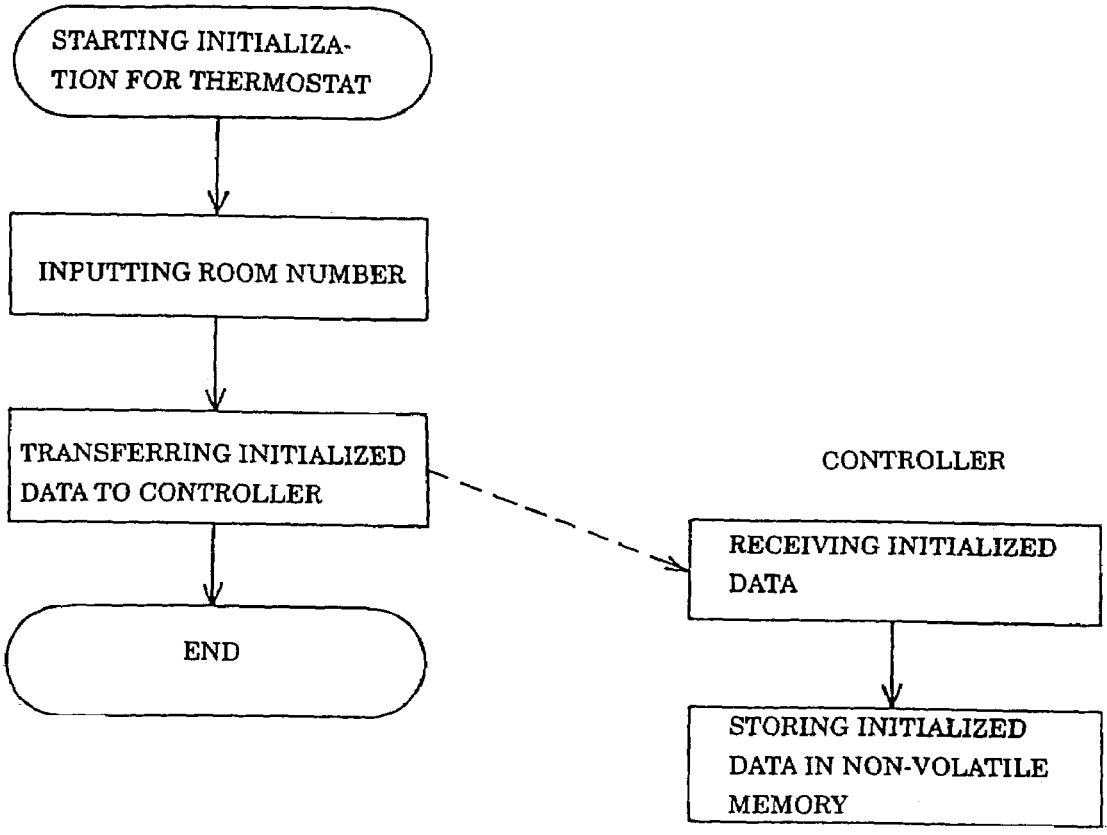
FIG. 18 is a flowchart showing room number initialization at each controller.

The room numbers are initialized as position data for the thermostats 33 . . . according to the procedure shown in FIG. 18. The MPU 59 of the thermostat 33 sends the controller 32 the initialization data concerning the room numbers and so on specified by the input unit 62 in the initialization mode, via the communication I/F 60. The MPU 35 in the controller 32 receives the initialized data from the thermostat 33 via the communication I/F 36, and stores them in the EEPROM 37.

Figure 19:
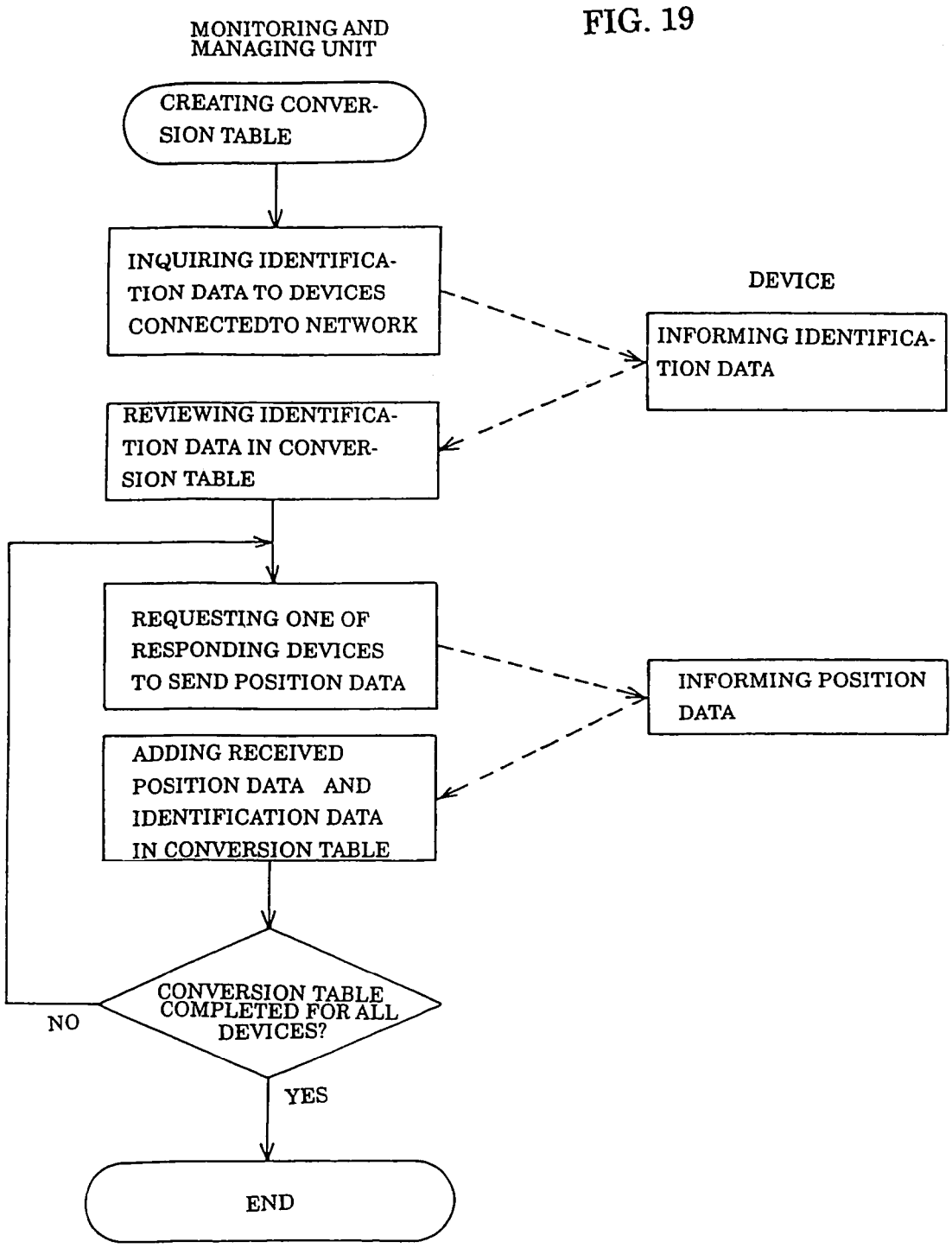
FIG. 19 is a flowchart showing a sequence for creating a conversion data base in a monitoring and control system.

The monitoring and managing unit 30 creates a conversion table as shown in FIG. 19, and inquires the identification data of the FCU controllers 11, 12 . . . via the network 31. The FCU controllers 11, 12 . . . transmit their identification data to the monitoring and managing unit 30 via the network 31, thereby informing their states.

The monitoring and managing unit 30 reviews the received identification data in the conversion table, and asks via the network 31 one of the responding ECU controllers to send the room number as the position data. The responding ECU controller reads the room number from the EEPROM 37, and sends it to the monitoring and managing unit 30 via the network 31. The monitoring and managing unit 30 correlates the received identification data and the position data, and adds them in the conversion table.

The monitoring and managing unit 30 performs the foregoing operation for all of the ECU controllers. The term "identification data" refers to communication addresses, for example, which are used for the monitoring and managing unit 30 to communicate with the ECU controllers. Generally, the identification data do not represent physical and actual positions of the ECU controllers.

Figure 20:
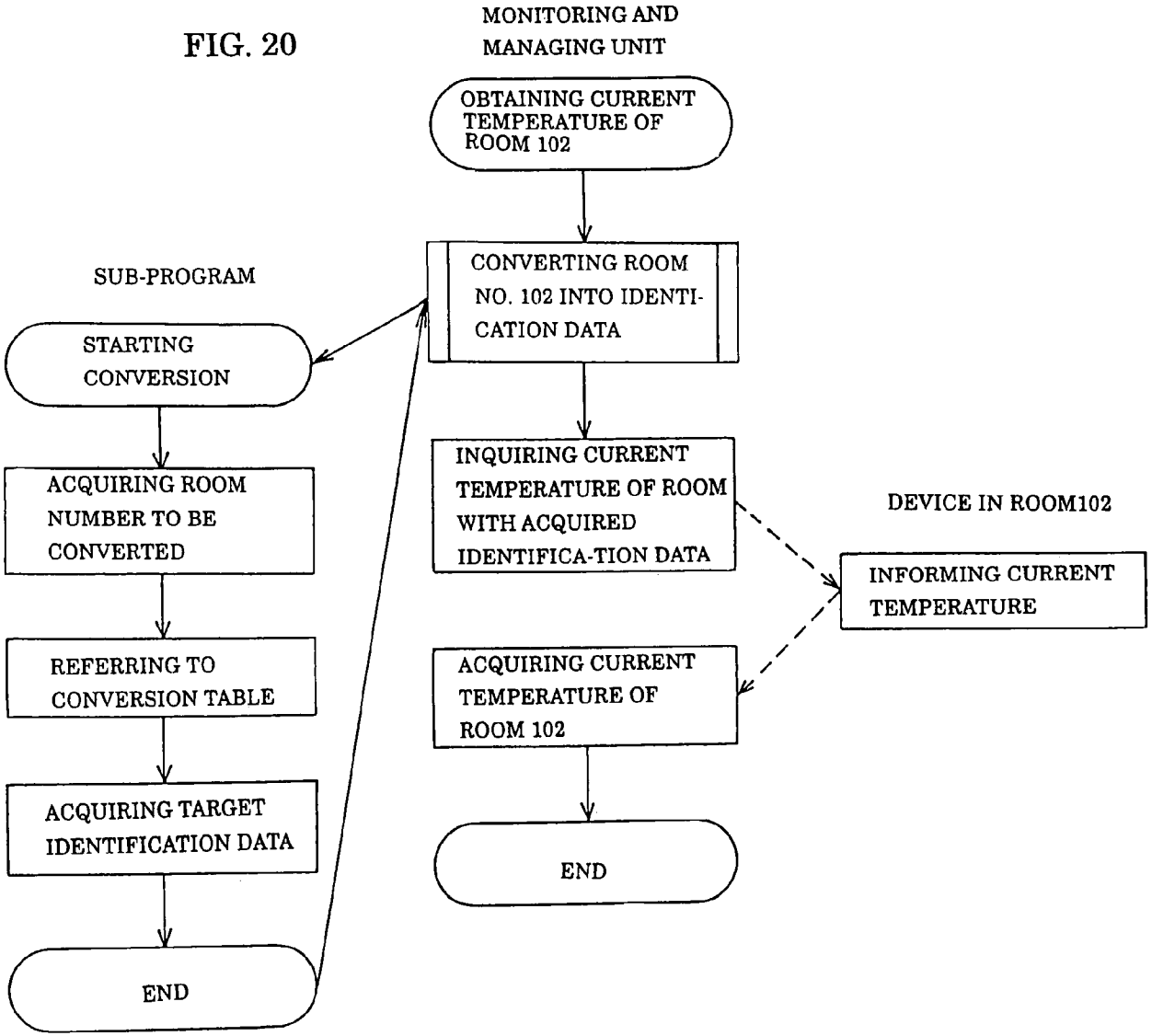
FIG. 20 is a flowchart showing how a conversion table is used.

FIG. 20 is a flowchart showing how the monitoring and managing unit 30 uses the conversion table (database). The monitoring and managing unit 30 converts the room number 102 (as the position data) into the identification data in accordance with a sub-program. In this case, the monitoring and managing unit 30 acquires the room number 102, refers to the conversion table, and derives the identification data of the room 102.

Thereafter, the monitoring and managing unit 30 inquires a current temperature of the room 102. The MPU 35 notifies the current room temperature of the room 102 to the monitoring and managing unit 30 via the communication interface unit 44 and the network 31.

The monitoring and managing unit 30 receives the current temperature of the room 102. Even if the ECU controller of the room 102 is out of use and is replaced by another controller having a different identification data, it is not necessary to change software of the monitoring and managing unit 30. Further, the conversion table can be easily updated by executing the program.

According to this embodiment, the monitoring and managing unit 30 communicates with a plurality of ECU controllers 11, 12 . . . in order to monitor and manage their operations. The ECU controllers 11, 12 . . . are provided with the input unit 62 for inputting the position data. The monitoring and managing unit 30 receives the identification data of the ECU controllers 11, 12 . . . , and correctly and automatically correlates the received identification data with the position data. Further, even if ECU controllers are added, removed or replaced, the monitoring and managing unit 30 can automatically correlate their identification data and position data only based on the position data inputted by such devices.

The monitoring and managing unit 30 is further provided with a converter for converting the position data into the identification data, and gets access to the ECU controllers 11, 12 . . . on the basis of the identification data. Therefore, the monitoring and managing unit 30 can access a particular ECU controller on the basis of the position data.

Further, the control system of this embodiment is constituted by: a plurality of controllers 32 and thermostats 33 for controlling the air-conditioners 50 to 52; communication interface unit 44 detachably connected to the controllers and thermostats 32 and 33; and the monitoring and managing unit 30 for controlling the operations of the controllers 32 and thermostats 33 via the communication interfaces unit 44. The controllers 32 and thermostats 33 directly control the air-conditioners 50 to 52 when no communication interface unit 44 is provided. Conversely, when the communication interface unit 44 is provided, the controllers 32 and thermostats 33 control the air-conditioners 50 to 52, under the control of the monitoring and managing unit 30, via the communication interface unit 44. Therefore, the control system of the invention is compatible with both of the centralized and de-centralized processing type control systems.

The controllers 32 and thermostats 33 are installed in individual rooms, and operate air-conditioners and so on in response to signals from occupancy sensors, i.e. operate air-conditioners when rooms are occupied, or operate them in the energy saving mode.

The controllers 32 and thermostats 33 further turn on the sterilizing lamps in the blow mode in order to circulate sterilized air.

The controllers 32 and thermostats 33 automatically operate ventilating fans in response to signals from the temperature sensors when room temperatures are above the predetermined value.

The following describe the operations of devices connected to the general input section 42 and the general output section 43.

It is assumed that a signal generated by a contact a (called the "a-contact signal") is initially set to be sent to the general input section 42, as shown in FIG. 21. When one of the devices connected to the general input section 42 is turned on, the MPU 35 performs the operation in accordance with the initialization data. Conversely, if a signal generated by a contact b (called the. "b-contact signal) is initially set to be sent to the general input section 42, the MPU 35 performs the operations on the basis of the initialization data when the device connected to the input section 42 is turned off.

The MPU 35 maintains the current operation state of the devices connected to the input section 42 in response to the a- or b-contact signal which is initially set to represent the operation continuation. Conversely, the MPU 35 interrupts the current operation of the foregoing devices in response to the a- or b-contact signal which is initially set to represent the operation suspension. When the a- or b-contact input signal is initially set to represent the occupied room mode operation, the MPU 35 starts the occupied room mode. When the a- or b-contact signal is initially set to represent the operation preparation mode, the MPU 35 starts the operation preparation mode. When the a- or b-contact signal is initially set to represent the vacant mode operation, the MPU 35 starts the vacant room mode. If the a- or b-contact signal is set to represent the trouble indication mode, the MPU 39 makes the liquid quartz display 66 indicate trouble via the communication I/F 39 and I/F 60. Further, the monitoring and managing unit 30 can monitor the state of the general input section 42 via the network 31 and the communication interface unit 44.

Figure 22:
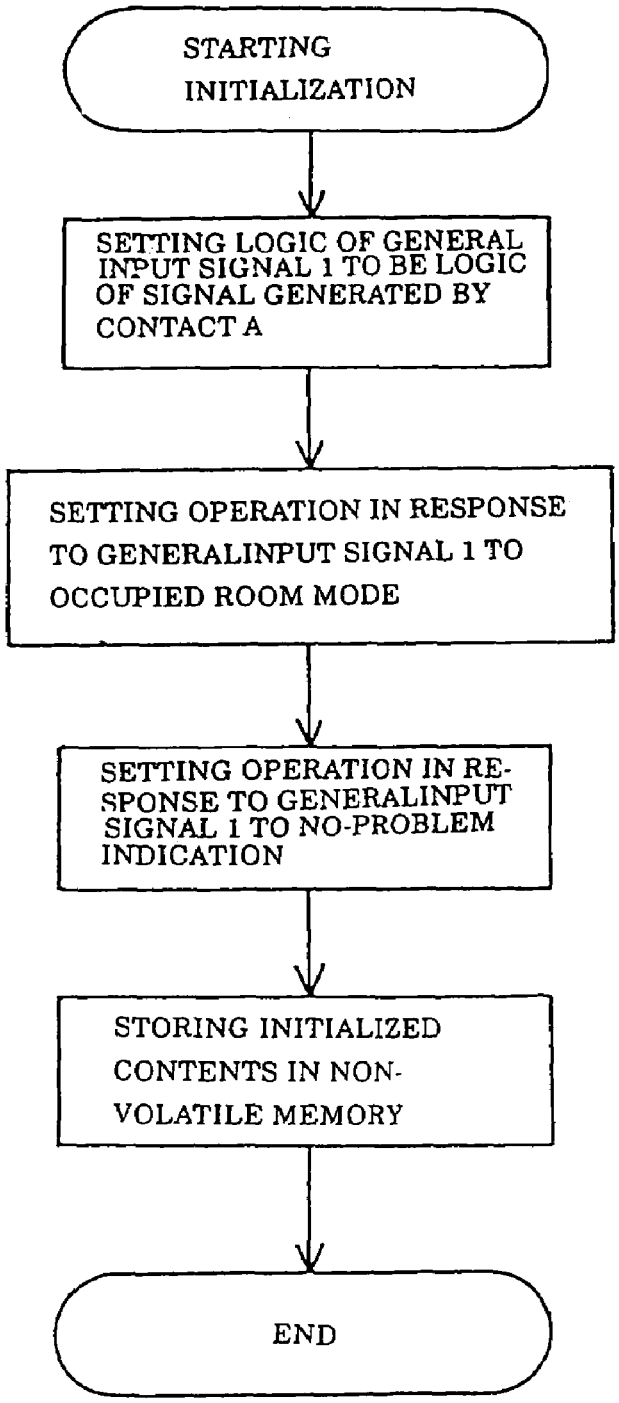
FIG. 22 is a flowchart showing the initialization related to a general input signal 1 applied to a general input section.

FIG. 22 shows the initialization related to a general input signal 1 to be sent to a first input terminal of the general input section 42. When the occupancy sensor whose contact is closed by detecting a person is connected to the first input terminal and when the general input signal 1 is sent to the general input section 42, the logic of the general input signal 1 is set to be the logic of the a-contact signal during the initialization, and the operation in response to the general input signal 1 is set to the operation start (occupied room mode). Further, the operation in response to the general input signal 1 is not subject to a problem indication.

Indications on the liquid quartz display 66 are changed by hitting the heating or cooling key 71 or 72, and are made to blink by the operation of the blow key 70, and are then changed to a steady state by re-operating the blow key 70.

In response to input signals from the heating or cooling key 71 or 72 and the blow key 70, the MPU 59 sets the logic of the general input signal 1 to be the logic of the a-contact signal, sets the operation in response to the general input signal 1 to the operation start (occupied room mode), and sets the operation in response to the general input signal 1 to no problem indication. The MPU 59 sends the initialized items to the MPU 35 via the communication I/F 60 and I/F 36. Thereafter, the MPU 0.35 stores the initialized items in the EEPROM 37. Alternatively, the monitoring and managing unit 30 can perform the foregoing setting via the network 31 and the communication interface unit 44.

Figure 23:
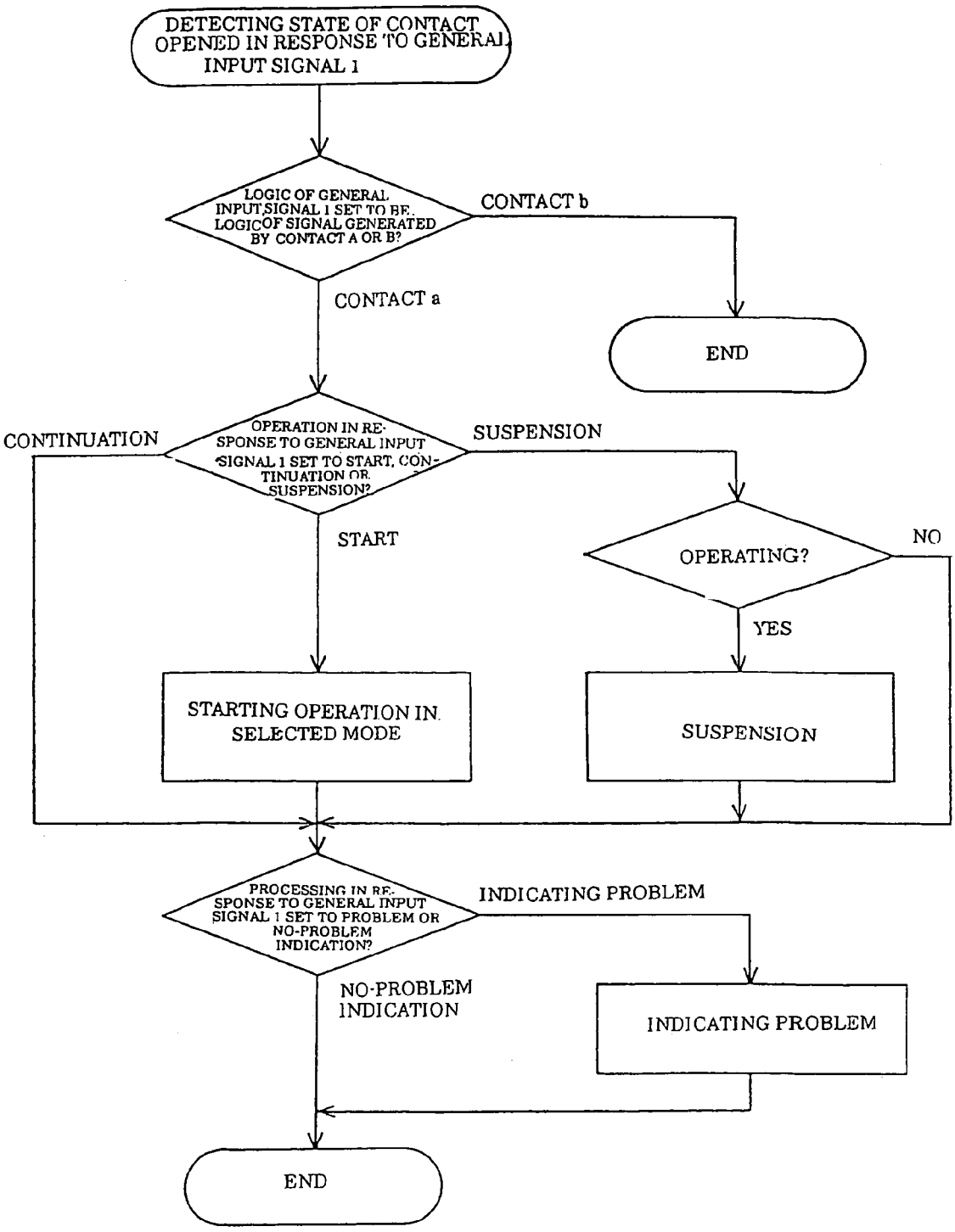
FIG. 23 is a flowchart showing the processing executed in response to the general input signal 1.

FIG. 23 is the flowchart showing the processing executed in response to the general input signal 1. The MPU 35 checks whether the logic of the general input signal 1 has been set to be the logic of the a- or b-contact signal on the basis of the initialized data. If the general input signal" is sent from the general input section 42 by the a-contact, the MPU 35 proceeds to the operation in response to the general input signal 1. Since the general input signal 1 is initially set to the operation start (occupied room mode), the MPU 35 starts the occupied room mode when the occupancy sensor is activated in response to the general input signal 1.

In this embodiment, the control system may automatically start operating when detecting that the room is occupied, and inform this to the monitoring and managing unit 30 via the network 31 and the communication interface unit 44.

Figure 24:
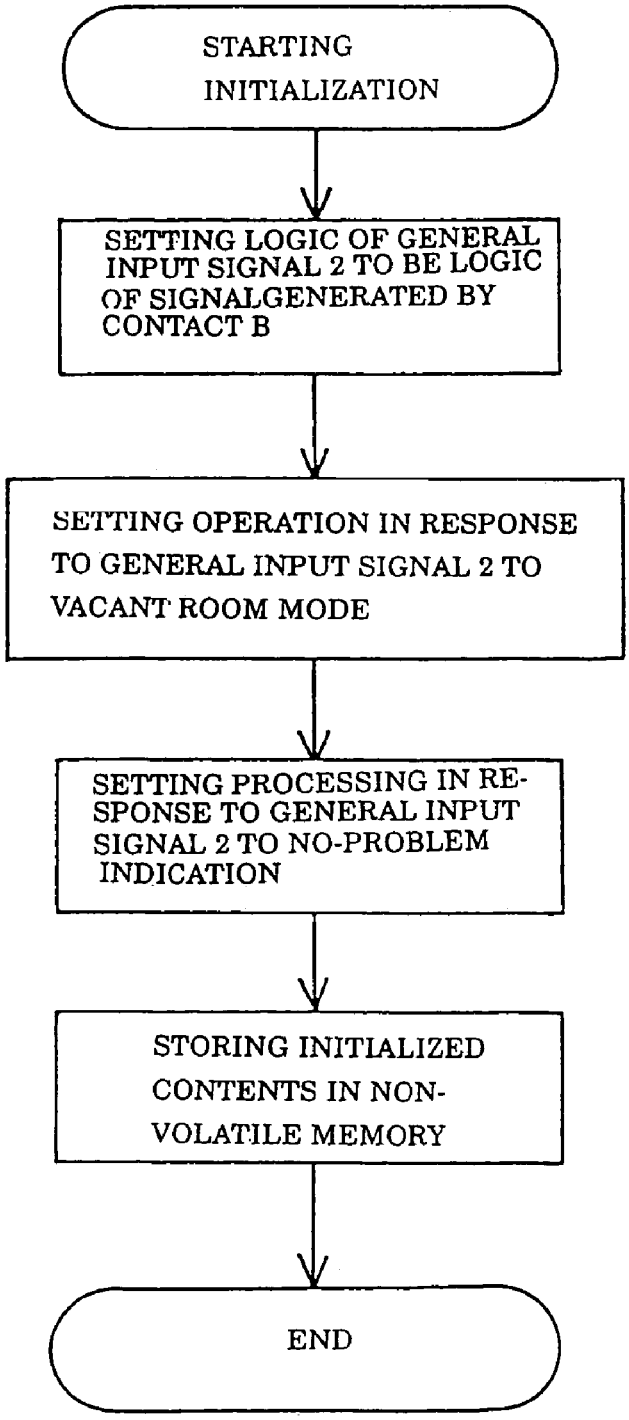
FIG. 24 is a flowchart showing the initialization related to a general input signal 2 applied to the general input section.

FIG. 24 shows the initialization which is performed for the general input 2 to be sent to a second input terminal of the general input section 42. When the occupancy sensor is connected to the second input terminal in order to send the general input 2 to the general input section 42, the logic of the general input 2 is set to be the logic of the b-contact signal during the initialization mode, and the operation in response to the general input 2 is set to the start in the vacant room mode. The processing in response to the general input signal 2 is not subject to the problem indication.

The indications on the liquid crystal display 66 are changed by depressing the heating or cooling key 71 or 72, and are made to blink by depressing the blow key 70. Thereafter, the blow key 70 is hit again in order to make the indications steady.

In response to the signals from the heating or cooling key 71 or 72 and the blow key 70, the MPU 59 sets the logic of the general input signal 2 to be the logic of the b-contact signal in order to activate any device connected to the general input section 2 in the vacant room mode, sets the processing in response to the general input signal 2 to no problem indication, and transmits the set operation mode data to the MPU 35 via the communication I/F 60 and I/F 36. The MPU 35 stores the received operation mode data in the EEPROM 37. Alternatively, the monitoring and managing unit 30 can perform the foregoing operations via the network 31 and the communication interface unit 44.

Figure 25:
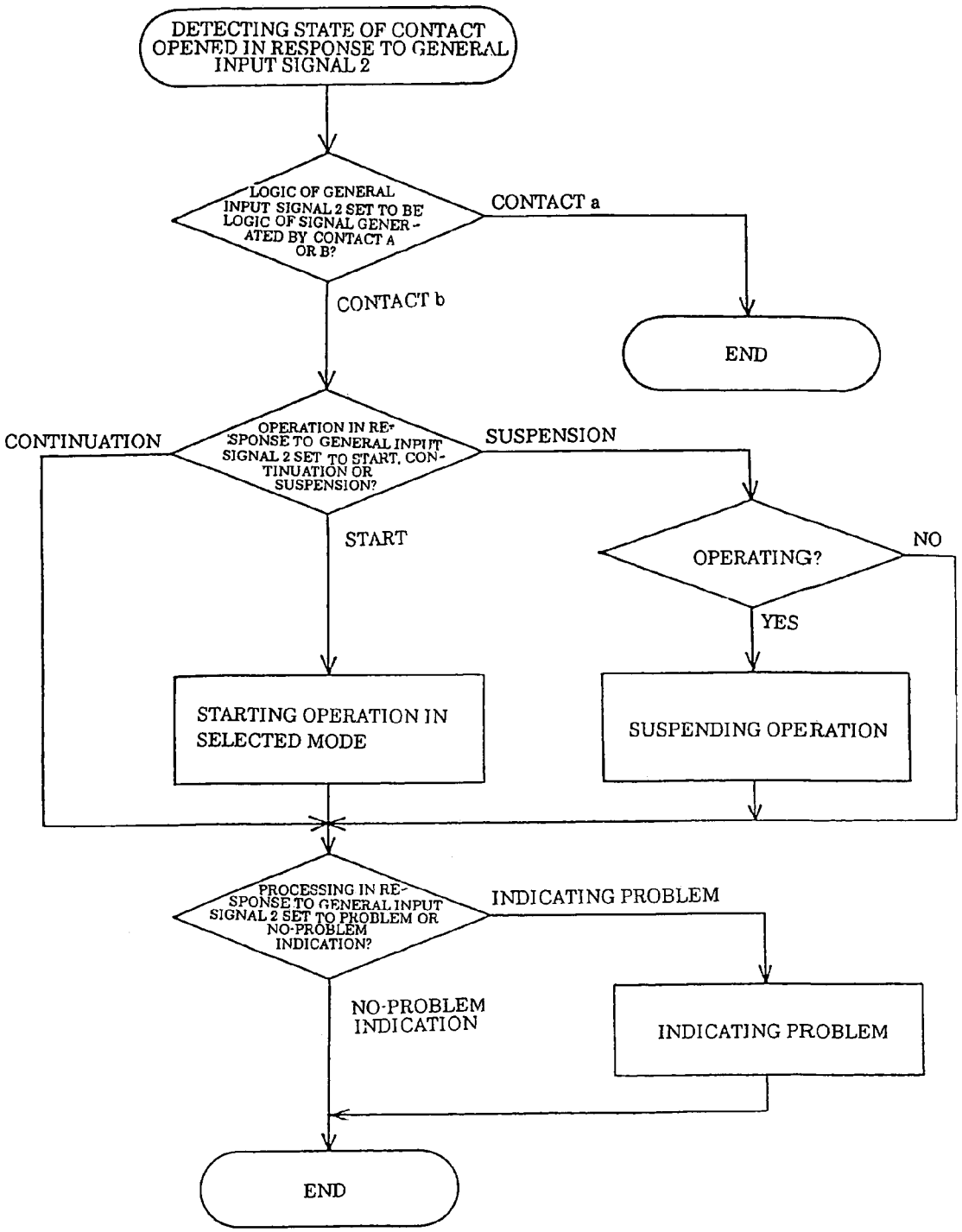
FIG. 25 is a flowchart showing the processing executed in response to the general input signal 2.

FIG. 25 shows the processing executed in response to the general input signal 2. The MPU 35 checks whether the logic of the general input 2 is set to be the logic of the a- or b-contact signal, on the basis of the initialized data, since the general input 2 is supplied to the contact b from the occupancy sensor via the general input section 42, the MPU 35 starts the operation in response to the general input 2. Specifically, the MPU 35 starts the vacant room mode when the room becomes vacant and the occupancy sensor is turned off. This is because the operation in response to the general input signal 2 has been set to the operation start (vacant room mode).

The vacant room mode is automatically started immediately after the room becomes vacant, which is effective in saving energy.

Figure 26:
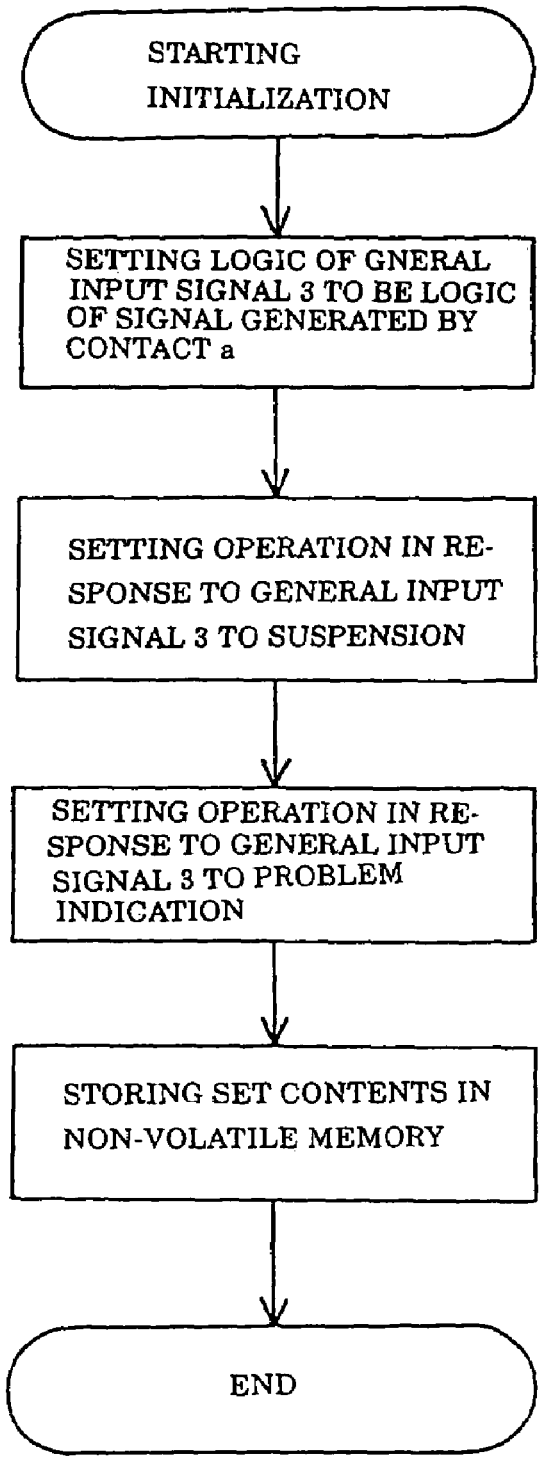
FIG. 26 is a flowchart showing the initialization related to a general input signal 3 inputted to the general input section.

The initialization for the general input signal 3, which is supplied to a third input terminal of the general input section 42, is carried out as shown in FIG. 26. When the fan trouble sensor is connected to the third input terminal, the general input 3 from the fan trouble sensor is supplied to the third input terminal, and the logic of the general input 3 is set to be inputted to the a-contact input in order to interrupt the operation in response to the general input 3. The operation in response to the general input signal 3 is indicated as a problem.

In this case, the items indicated on the liquid crystal display 66 are changed by depressing the heating key 71 or the cooling key 72. The indications of the display 66 are made to blink by hitting the blow key 70. Thereafter, the blow key 70 is again depressed in order to make the indications steady.

In response to the signals from the heating or cooling key 71 or 72 and the blow key 70, the MPU 59 sets the logic of the general input signal 3 to be the logic of the a-contact signal, and sets the operation in response to the general input signal 3 to the operation suspension during the initialization. Further, the operation in response to the general input signal 3 is indicated as a problem. Alternatively, the foregoing operation can be carried out by the monitoring and managing unit 30 via the network 31 and the communication interface unit 44.

Figure 27:
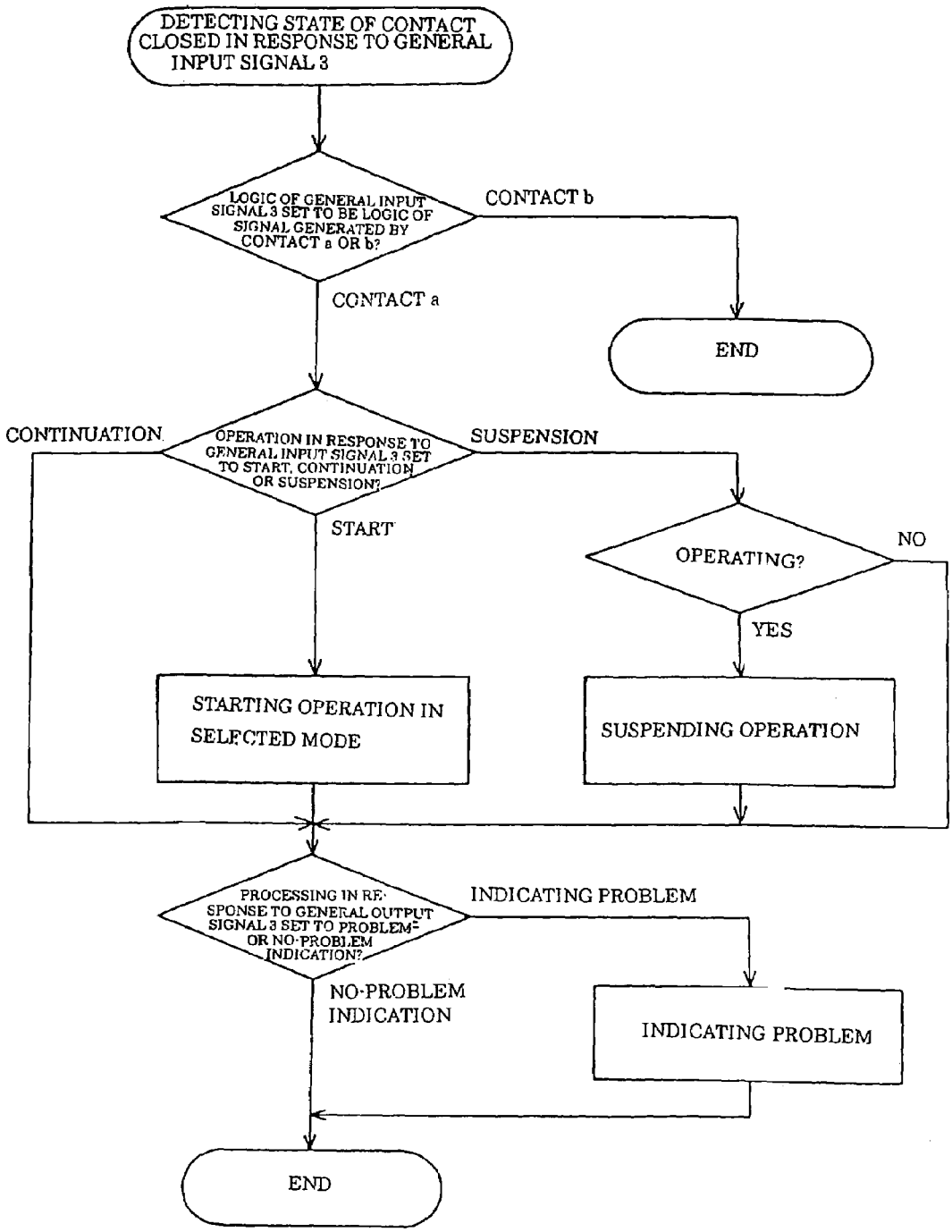
FIG. 27 is a flowchart showing the processing executed in response to the general input signal 3.

The processing is carried out in response to the general input signal 3 as shown in FIG. 27. The MPU 35 checks whether the logic of the general input 3 is set to be the logic of the a- or b-contact signal, on the basis of the initial data in the EEPROM 37. When the general input signal 3 sent from the fan trouble sensor via the general input section 42 is the a-contact signal, the MPU 35 proceeds to the operation in response to the general input signal 3. Since the operation in response to the general input signal 3 has been initially set to the operation interruption, the MPU 35 stops operating when the fan trouble sensor is turned on (i.e. while the FCU 50 and the valves 51 and 52 are being controlled) in response to the general input 3.

The control system stops operating the FCU 50 and indicates the fan trouble when the fan of the FCU 50 becomes out of use. This state can be notified to the monitoring and managing unit 30 via the network 31 and the communication interface unit 44.

Figure 28:
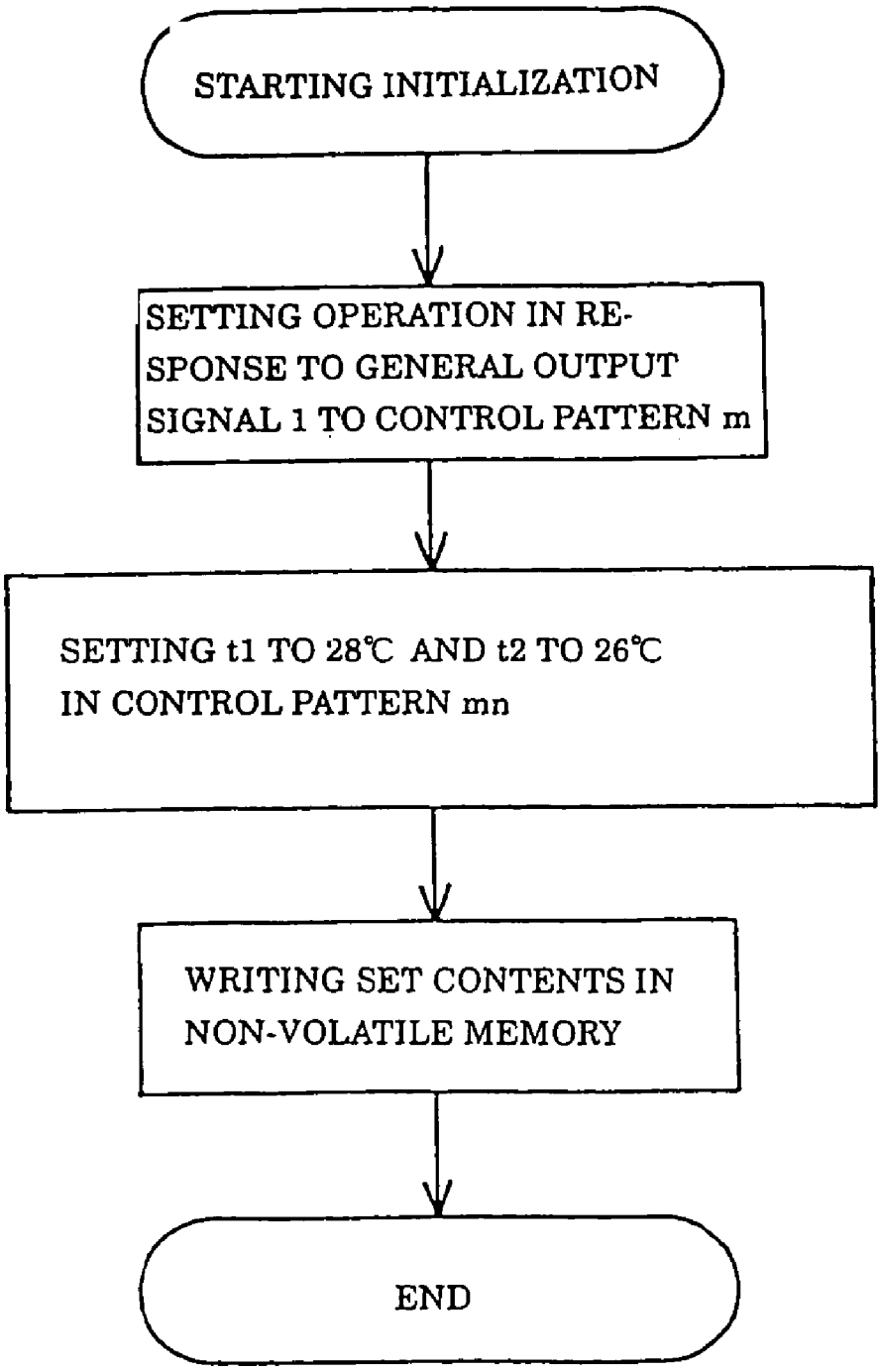
FIG. 28 is a flowchart showing the initialization related to a general output signal 1 outputted from a general output section.

FIG. 28 shows the initialization performed in response to a general output signal 1 received from the general output section 43. A ventilating fan is connected to a first output terminal of the general output section 43, SO that the general output signal 1 is supplied to the ventilating fan via the first terminal. In this case, the general output signal 1 is initially set to a pattern m in which temperature t1 is 28° C. and temperature t2 is 26° C.

In this case, the heating or cooling key 71 or 72 is depressed in order to change the indications on the liquid crystal quartz display 66, which are made to blink by hitting the blow key 70, and then are changed to a steady state by re-depressing the blow key 70.

The MPU59 sets the general output signal 1 to the m-pattern (temperature t1: 28° C. and temperature t2: 26° C.) in response to input signals from the heating and cooling keys 71 and 72 and the blow key 70, and notifies the contents to the MPU 35 via the communication I/F60 and I/F 36. The MPU 35 stores the set contents in the EEPROM 37. The monitoring and managing unit 30 can perform the foregoing initialization via the network 31 and communication interface unit 44.

Figure 32:
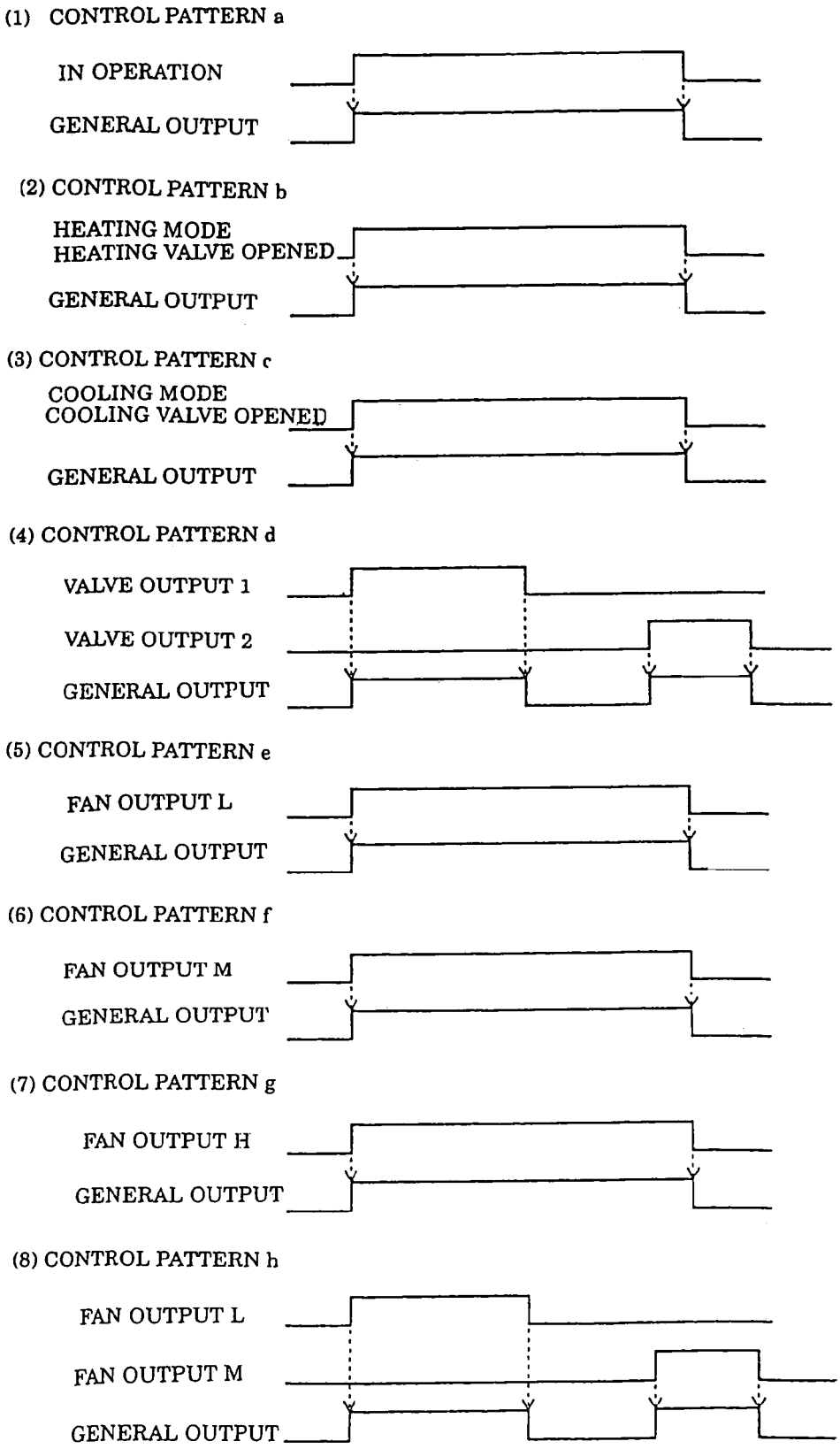
FIG. 32 shows control patterns.
Figure 33:
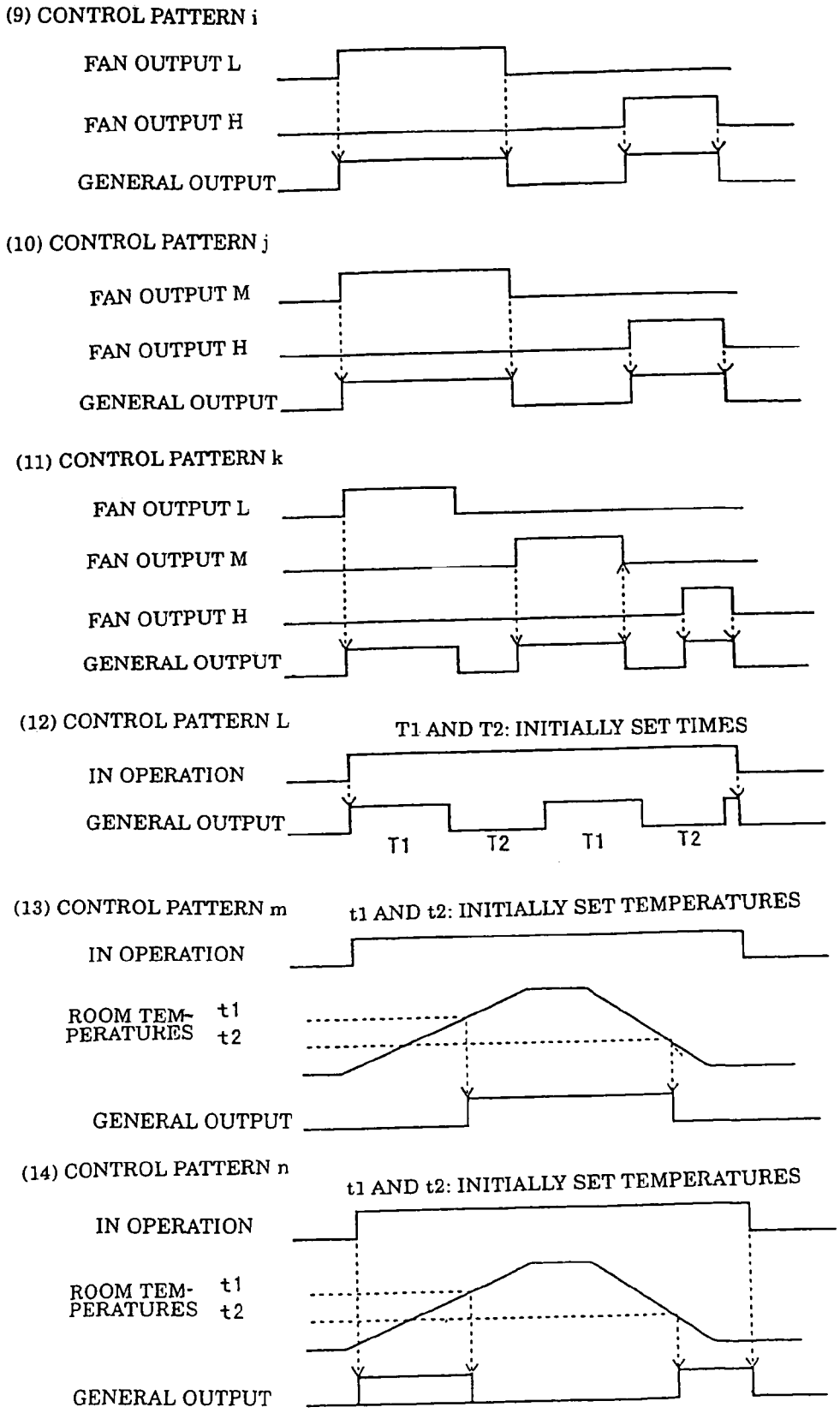
FIG. 33 shows further control patterns.

The EEPROM 37 stores a plurality of control patterns a to n which are used to supply a general output signal from the general output section 43, as shown in FIGS. 32 and 33. During the initialization, any of the control patterns a to n is selected in accordance with a device connected to the general output section 43. Referring to FIG. 32(1), the control pattern a is used to supply the general output signal during the operation of devices. The control pattern b of FIG. 32(2) is used to supply the general output signal 1 when the heating valve is opened during the heating mode.

The control pattern c shown in FIG. 32(3) is used to supply the general output signal when the cooling valve is opened in the cooling mode. The control pattern d of FIG. 32(4) is for supplying the general output signal in response to valve driving outputs 1 and 2 for operating the valves 51 and 52. The control pattern e of FIG. 32(5) is for supplying the general output signal in response to a fan output L which rotates the fan of the FCU 50 in the light breeze mode. The control pattern f of FIG. 32(6) is used to supply the general output signal in response to a fan output M which rotates the fan in the moderate breeze mode.

The control pattern g of FIG. 32(7) is used to supply the general output signal in response to a fan output H which rotates the fan in the fresh breeze mode. The control pattern g of FIG. 32(8) is for supplying the general output signal in response to the fan outputs L and M. The control pattern i of FIG. 33(9) is for supplying the general output signal response to the fan outputs L and H. The control pattern i of FIG. 33(10) is for supplying the general output signal in response to the fan outputs M and H.

The control pattern k of FIG. 33(11) is for supplying the general output signal in response to the fan outputs L, M and H. The control pattern l of FIG. 33(12) is for alternately supplying and interrupting the general output for the times T1 and T2 which are set in the initialization. The control pattern m of FIG. 33(13) us for supplying the general output signal when the room temperature becomes equal to or higher than the initially set temperature t1, and for interrupting the general output signal when the room temperature becomes equal to or lower than the initially set temperature t2. The control pattern n of FIG. 33(14) is for supplying the general output signal when devices connected to the general output section 43 are activated, interrupting the general output signal when the room temperature becomes equal to or lower than temperature t1, supplying the general output signal when the room temperature becomes equal to or lower than t2, and interrupting the general output signal when the foregoing devices stop operating.

Figure 29:
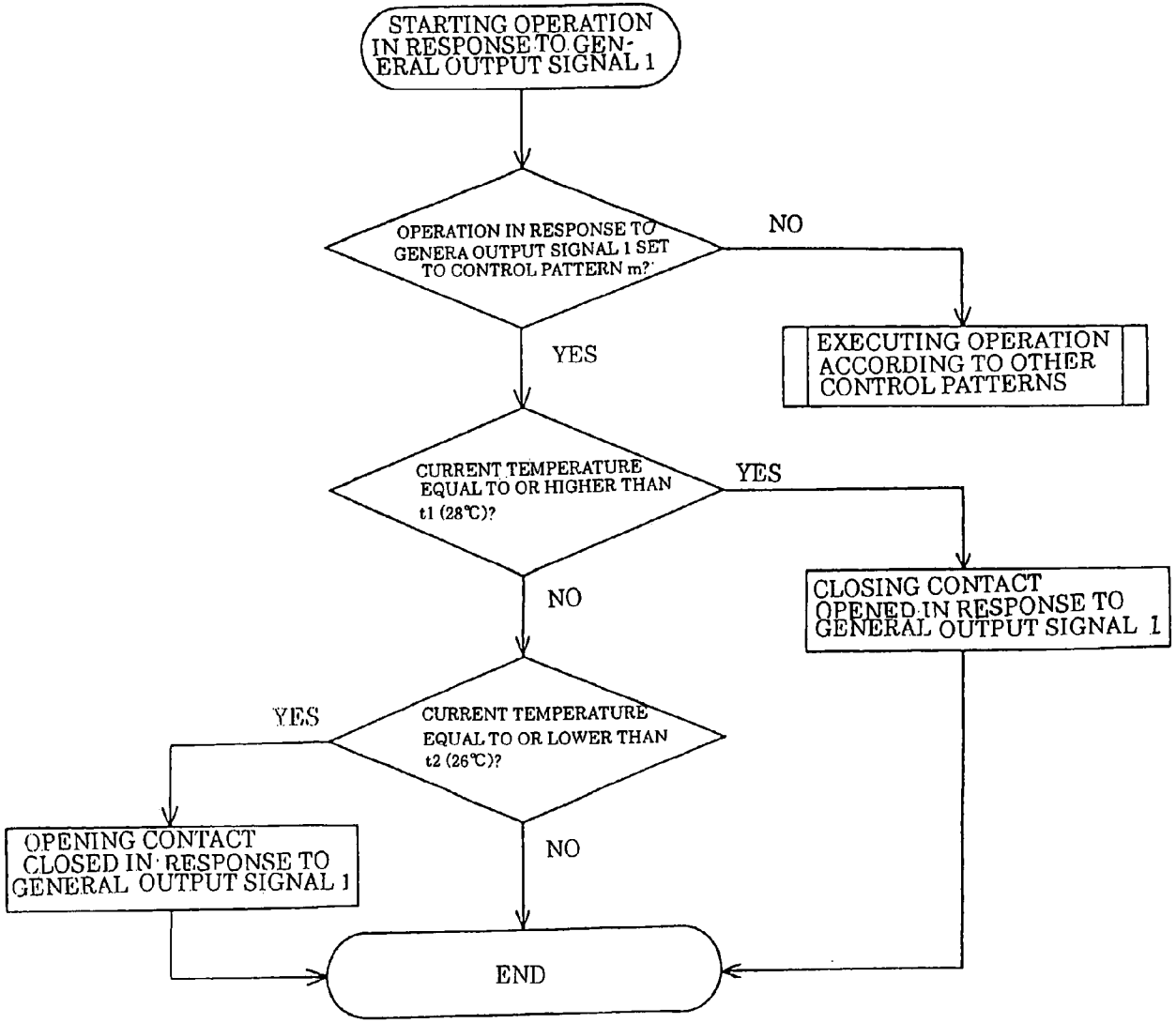
FIG. 29 is a flowchart showing the processing executed in response to the general output signal 1.

FIG. 29 shows the sequence in which the operation is performed in response to a general output signal 1. The MPU 35 checks whether the general output signal 1 is initially set to the control pattern m. If the general output signal 1 has been set to the control pattern m, the MPU 35 checks whether or not the room temperature is equal to or higher than t1 (28° C.). When the room temperature is equal to or higher than t1, the MPU 35 closes a contact in order to supply the general output signal 1, which rotates the ventilating fan.

If the room temperature is not equal to or higher than t1. (28° C.), the MPU 35 checks whether the room temperature is equal to or lower than t2 (26° C.). If it is equal to or lower than t2, the MPU 35 opens the contact in order to interrupt the general output signal 1, thereby stopping the ventilating fan.

In short, the ventilating fan is activated whenever the room temperature is equal to or higher than t1, which is effective in ventilating the room both in the winter and the summer, and in saving energy by introducing the air.

Figure 30:
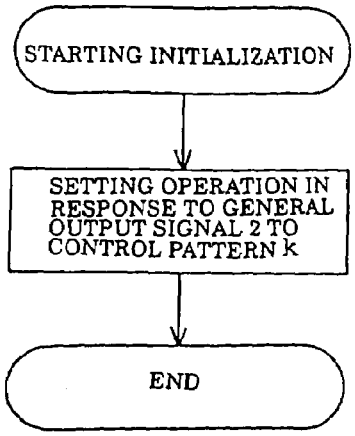
FIG. 30 is a flowchart showing the initialization related to a general output signal 2 received from the general output section.

FIG. 30 shows the initialization for a general output signal 2 transmitted from a second output terminal of the general output section 43. The sterilizing lamp is connected to the second output terminal of the general output section 43. In order to activate the sterilizing lamp, the general output signal 2 is set to the control pattern k. The indications on the liquid crystal quartz display 66 are changed by operating the heating or cooling key 71 or 72, and made to blink by depressing the blow key 70. Thereafter, the blow key 70 is again depressed in order to make the indications steady.

During the initialization, the MPU 59 sets the operation in response to the general output signal 2 to the control pattern k in response to signals from the heating or cooling key 71 or 72 and the blow key 70, and transmits the set contents to the MPU 35 via the communication I/F 60 and I/F 36. The MPU 35 stores the received contents in the EEPROM 37.

Alternatively, the foregoing operation may be carried out by the monitoring and managing unit 30 via the network 31 and communication interface unit 44.

Figure 31:
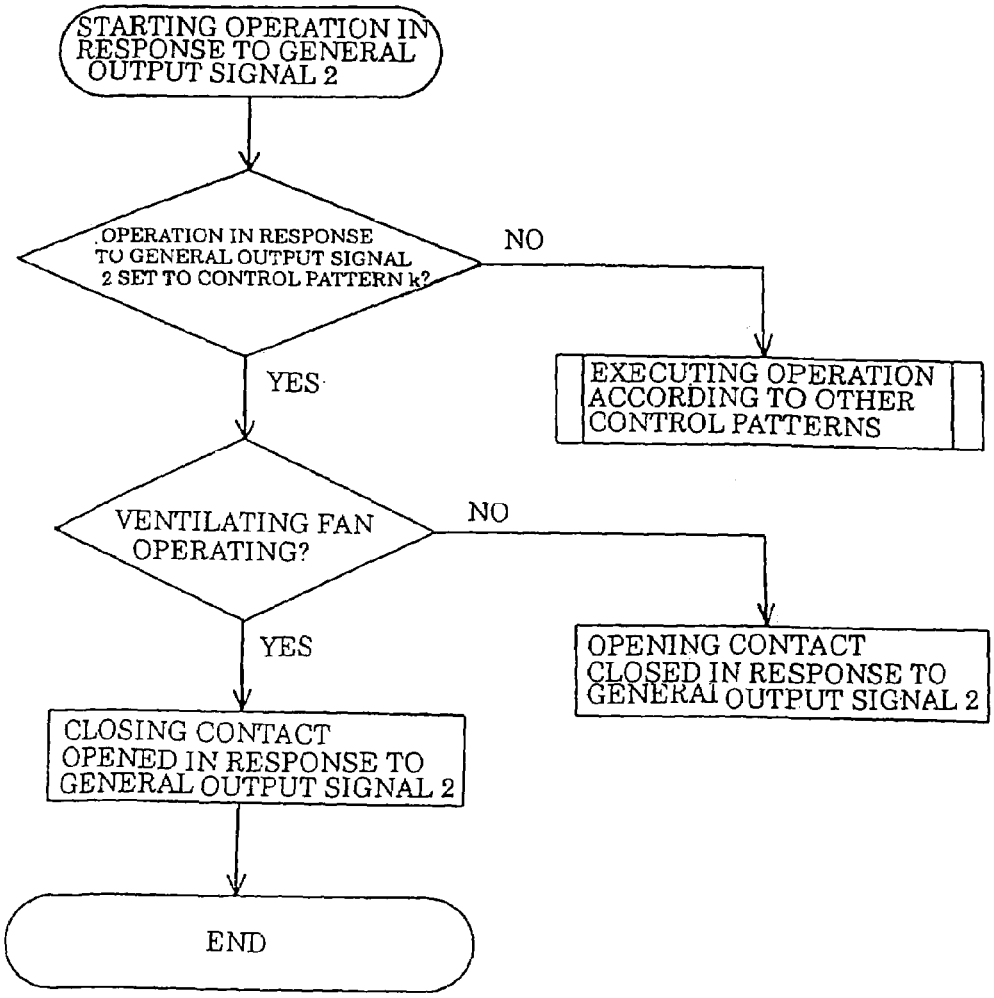
FIG. 31 is a flowchart showing the processing executed in response to the general output signal 2.

Referring to FIG. 31, the MPU 35 checks whether the operation in response to the general output signal 2 has been set to the control pattern k on the basis of the contents stored in the EEPROM 37. When the operation has been set to the pattern k, the MPU 35 further checks whether or not the fan of the FCU 50 is active in response to the fan output L, M or H. If the fan of the FCU 50 is inactive, the MPU 35 opens the contact of the general output section 43 in order to interrupt the general output signal 2, thereby deactivating the fan of the FCU 50. Conversely, if the fan of the FCU 50 is active, the MPU 35 closes the contact of the general output section 43 in order to supply the general output 2, thereby activating turning the sterilizing lamp.

In this embodiment, the sterilizing lamp is activated during the operation of the fan, thereby supplying the sterilized air to the room.

Alternatively, other devices may be connected to the general output section 43 in place of the ventilating fan and the sterilizing lamp, and may be initially set to any of the control patterns a to n stored in the EEPROM 37. Further, other devices may be connected to the general input section 42 in place of the occupancy sensor and fan trouble sensor. It is possible to control the devices connected to the controller 32 using the general input signal supplied from them to the general input section 42.

According to the invention, each of the FCU controllers 11, 12, . . . for controlling the FCU 50, valves 51 and 52, and so on comprises: the general output section 43 to which optional devices are connected; the EEPROM 37 which stores the control patterns a to n for controlling the operations of the devices; and the input unit 62 for selecting the control patterns a to n in order to control the operations of first devices. Therefore, it is possible to add, replace, cancel or remodel any devices connected to the general output section, which is effective in reducing a renewal cost.

Further, the general input section 42 is used to connect optional devices. The input unit 62 selects the control patterns a to n in accordance with devices connected to the general output section 43. The control system controls second devices connected to the controller 32 in accordance with the control patterns in response to the input signals from the devices connected to the general input section 42. Therefore, it is possible to add, cancel or remodel the devices connected to the general input section, which is effective in reducing a renewal cost.

INDUSTRIAL APPLICABILITY

The invention has been described mainly with respect to its application to building maintenance for controlling the operations of air-conditioning devices, but is also applicable to management of various facilities. Further, the invention is compatible with a central unit which can monitor or manage the operations of a variety of devices, and also enables a central unit to monitor and/or manage devices such as air handling unit (AHU) controllers or an entrance/exit monitoring unit.

What is claimed is:

1. A facility control system comprising control units each of which controls an air conditioner and at least one output optional device and includes:

a general input section to which at least one optional input device is connected and a general output section to which at least one optional output device is connected;

a memory storing a plurality of control patterns; and a temperature setting device provided with setting means for setting control patterns for controlling the at least one optional output device from among the plurality of control patterns in accordance with at least one of the optional input and output devices connected to the general input and general output sections;

whereby the control patterns set by the setting means of the temperature setting device enable addition, removal and remodeling the at least one input optional device and the at least one output optional general device, the at least one optional output device including at least one of a sterilization lamp or an extractor fan.

2. The facility control system of claim 1, wherein the setting means for setting control patterns sets any of the control patterns for any optional output devices connected to the general output section, and each control unit controls second devices connected thereto in accordance with control patterns selected in response to signals received from any optional input devices connected to the general input section.

* * * * *